US007306320B2

(12) United States Patent
Silverbrook

(10) Patent No.: US 7,306,320 B2
(45) Date of Patent: Dec. 11, 2007

(54) HIGH SPEED DIGITAL PRINTER UNIT

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 379 days.

(21) Appl. No.: 11/014,722

(22) Filed: Dec. 20, 2004

(65) Prior Publication Data

US 2005/0099454 A1 May 12, 2005

Related U.S. Application Data

(63) Continuation-in-part of application No. 10/760,254, filed on Jan. 21, 2004.

(51) Int. Cl.
*B41J 2/155* (2006.01)
*B41J 2/01* (2006.01)

(52) U.S. Cl. ..... 347/42; 347/101

(58) Field of Classification Search ..... 347/42, 347/101

See application file for complete search history.

(56) References Cited

U.S. PATENT DOCUMENTS 4,985,710 A 1/1991 Drake
5,160,945 A 11/1992 Drake
5,221,397 A 6/1993 Nystrom
5,512,924 A * 4/1996 Takada et al. ..... 347/18
6,017,117 A 1/2000 Mc Clelland et al.
6,270,177 B1 8/2001 King et al.
6,281,912 B1 8/2001 Silverbrook
6,282,769 B1 5/2002 Silverbrook
6,382,769 B1 5/2002 Silverbrook
6,439,908 B1 8/2002 Silverbrook et al.
6,443,555 B1 9/2002 Silverbrook et al.
6,554,398 B2 4/2003 Wyangaert et al.
6,557,976 B2 5/2003 McElfresh et al.
6,652,082 B2 11/2003 Silverbrook
6,672,706 B2 1/2004 Silverbrook
6,679,584 B2 1/2004 Silverbrook
6,793,319 B2 * 9/2004 Ikemoto et al. ..... 347/40

FOREIGN PATENT DOCUMENTS

WO WO 00/35675 A1 6/2000
WO WO 03/086764 A1 10/2003
WO WO 03/086770 A1 10/2003

* cited by examiner

*Primary Examiner*—Thinh Nguyen

(57) ABSTRACT

An printer unit is provided comprising a body having a media input assembly for supporting media for printing, a media output assembly for collecting printed media and a print engine adapted to be mounted to said body and having a printhead for printing an image on a surface of the media. The printhead being a pagewidth printhead that is removable from the print engine.

55 Claims, 27 Drawing Sheets

HIGH SPEED DIGITAL PRINTER UNIT

The present application is a Continuation-In-Part application of U.S. Ser. No. 10/760,254 filed on Jan. 21, 2004. In the interests of brevity, the disclosure of the parent application is incorporated in its entirety into the present specification by cross reference.

CO-PENDING APPLICATIONS

The following applications have been filed by the Applicant simultaneously with the present application:

| | | | | | |
|---|---|---|---|---|---|
| 7152972 | 11/014731 | 11/014764 | 11/014763 | 11/014748 | 11/014747 |
| 11/014761 | 11/014760 | 11/014757 | 11/014714 | 11/014713 | 11/014762 |
| 11/014724 | 11/014723 | 11/014756 | 11/014736 | 11/014759 | 11/014758 |
| 11/014725 | 11/014739 | 11/014738 | 11/014737 | 11/014726 | 11/014745 |
| 11/014712 | 11/014715 | 11/014751 | 11/014735 | 11/014734 | 11/014719 |
| 11/014750 | 11/014749 | 11/014746 | 11/014769 | 11/014729 | 11/014743 |
| 11/014733 | 11/014754 | 11/014755 | 11/014765 | 11/014766 | 11/014740 |
| 11/014720 | 11/014753 | 11/014752 | 11/014744 | 11/014741 | 11/014768 |
| 11/014767 | 11/014718 | 11/014717 | 11/014716 | 11/014732 | 11/014742 |
| 11/014728 | 11/014727 | 11/014730 | | | |

The disclosures of these co-pending applications are incorporated herein by reference.

CROSS REFERENCES TO RELATED APPLICATIONS

The following patents or patent applications filed by the applicant or assignee of the present invention are hereby incorporated by cross-reference.

| | | | | | |
|---|---|---|---|---|---|
| 11/003786 | 11/003616 | 11/003418 | 11/003334 | 11/003600 | 11/003404 |
| 11/003419 | 11/003700 | 11/003601 | 11/003618 | 11/003615 | 11/003337 |
| 11/003698 | 11/003420 | 6984017 | 11/003699 | 11/003463 | 11/003701 |
| 11/003683 | 11/003614 | 11/003702 | 11/003684 | 11/003619 | 11/003617 |
| 6623101 | 6406129 | 6505916 | 6457809 | 6550895 | 6457812 |
| 7152962 | 6428133 | 7204941 | 10/815624 | 10/815628 | 10/913375 |
| 10/913373 | 10/913374 | 10/913372 | 7138391 | 7153956 | 10/913380 |
| 10/913379 | 10/913376 | 7122076 | 7148345 | 10/407212 | 10/407207 |
| 10/683064 | 10/683041 | 10/882774 | 10/884889 | 10/922890 | 10/922875 |
| 10/922885 | 10/922889 | 10/922884 | 10/922879 | 10/922887 | 10/922888 |
| 10/922874 | 10/922873 | 10/922871 | 10/922880 | 10/922881 | 10/922882 |
| 10/922883 | 10/922878 | 10/922872 | 10/922876 | 10/922886 | 10/922877 |
| 6746105 | 7156508 | 7159972 | 7083271 | 7165834 | 7080894 |
| 7201469 | 7090336 | 7156489 | 10/760233 | 10/760246 | 7083257 |
| 10/760243 | 10/760201 | 10/760185 | 10/760253 | 10/760255 | 10/760209 |
| 7118192 | 10/760194 | 10/760238 | 7077505 | 7198354 | 7077504 |
| 10/760189 | 7198355 | 10/760232 | 10/760231 | 7152959 | 7213906 |
| 7178901 | 10/760227 | 7108353 | 7104629 | 10/728804 | 7128400 |
| 7108355 | 6991322 | 10/728790 | 7118197 | 10/728970 | 10/728784 |
| 10/728783 | 7077493 | 6962402 | 10/728803 | 7147308 | 10/728779 |
| 7118198 | 7168790 | 7172270 | 10/773199 | 6830318 | 7195342 |
| 7175261 | 10/773183 | 7108356 | 7118202 | 10/773186 | 7134744 |
| 10/773185 | 7134743 | 7182439 | 7210768 | 10/773187 | 7134745 |
| 7156484 | 7118201 | 7111926 | 10/773184 | 09/575197 | 7079712 |
| 09/575123 | 6825945 | 09/575165 | 6813039 | 6987506 | 7038797 |
| 6980318 | 6816274 | 7102772 | 09/575186 | 6681045 | 6728000 |
| 7173722 | 7088459 | 09/575181 | 7068382 | 7062651 | 6789194 |
| 6789191 | 6644642 | 6502614 | 6622999 | 6669385 | 6549935 |
| 6987573 | 6727996 | 6591884 | 6439706 | 6760119 | 09/575198 |
| 7064851 | 6826547 | 6290349 | 6428155 | 6785016 | 6831682 |
| 6741871 | 6927871 | 6980306 | 6965439 | 6840606 | 7036918 |
| 6977746 | 6970264 | 7068389 | 7093991 | 7190491 | 10/884883 |
| 10/901154 | 10/932044 | 10/962412 | 7177054 | 10/962552 | 10/965733 |
| 10/965933 | 10/974742 | 10/986375 | 6982798 | 6870966 | 6822639 |
| 6737591 | 7055739 | 09/575129 | 6830196 | 6832717 | 6957768 |
| 7170499 | 7106888 | 7123239 | 10/727181 | 10/727162 | 10/727163 |
| 10/727245 | 7121639 | 7165824 | 7152942 | 10/727157 | 7181572 |

-continued

| | | | | | |
|---|---|---|---|---|---|
| 7096137 | 10/727257 | 10/727238 | 7188282 | 10/727159 | 10/727180 |
| 10/727179 | 10/727192 | 10/727274 | 10/727164 | 10/727161 | 10/727198 |
| 10/727158 | 10/754536 | 10/754938 | 10/727227 | 10/727160 | 10/934720 |
| 10/296522 | 6795215 | 7070098 | 7154638 | 6805419 | 6859289 |
| 6977751 | 6398332 | 6394573 | 6622923 | 6747760 | 6921144 |
| 10/884881 | 7092112 | 7192106 | 10/854521 | 10/854522 | 10/854488 |
| 10/854487 | 10/854503 | 10/854504 | 10/854509 | 7188928 | 7093989 |
| 10/854497 | 10/854495 | 10/854498 | 10/854511 | 10/854512 | 10/854525 |
| 10/854526 | 10/854516 | 10/854508 | 10/854507 | 10/854515 | 10/854506 |
| 10/854505 | 10/854493 | 10/854494 | 10/854489 | 10/854490 | 10/854492 |
| 10/854491 | 10/854528 | 10/854523 | 10/854527 | 10/854524 | 10/854520 |
| 10/854514 | 10/854519 | 10/854513 | 10/854499 | 10/854501 | 10/854500 |
| 10/854502 | 10/854518 | 10/854517 | 10/934628 | | |

FIELD OF THE INVENTION

The present invention relates to a printer unit, and more particularly to an inkjet printer unit capable of printing high quality images at high speeds and being of a size that is readily accommodated on a desktop.

Some applications have been listed by docket numbers. These will be replaced when application numbers are known.

BACKGROUND OF THE INVENTION

Desktop printer units for use in a home or office environment are well known and constitute a major proportion of printer units currently manufactured and sold. Such units are arranged to be positioned on a surface of a desk or workstation, in close proximity to a computer system, such as a personal computer, digital camera or the like. In this arrangement, an image can be selected from the computer system and sent to the printer unit for printing, and the printed image can be conveniently collected from the printer unit without requiring the user to leave their desk or office.

Traditionally, the primary focus of manufacturers of desktop printer units of this type has been to provide a simple unit that achieves this convenient mode of operation. As a result, most commercially available desktop printer units are limited in relation to printing speeds with which they operate and the print quality of the image produced. In many cases, such desktop printer units are only capable of producing monochrome images and those units capable of printing in full colour and photo quality, typically do so at a speed less than 5 pages per minute (ppm). As a result, if a print job comprises a number of pages requiring high resolution, full colour printing, it has often been more cost and time effective to send the print job to a remote printer unit dedicated to performing such a task. Therefore, the inability of conventional desktop printer units to operate at high speeds and to produce high quality print images diminishes the overall convenience of such printer units.

Additionally, the current trend of optimising workspaces in both the home and office to create a more eclectic and variable work environment has resulted in a reduction of space available for traditional workplace components, such as computers and the like. In recent times, the size of personal computers, and in particular computer monitors, has reduced dramatically with the advent of slim-line, flat screen monitors, which minimise the desk space occupied by such components. Traditionally, desktop printer units have been of a size largely dictated by the size of the print media required for printing as well as the manner in which printing is performed, which has made it difficult for manufacturers to keep with this trend.

Most desktop printer units are of the inkjet type, and employ a reciprocating carriage containing a printhead which ejects ink as it traverses the print media. Such printer units are limited with regard to the speeds at which they can operate, as in order to print a single line of an image, the printhead may need to traverse the stationary print media a number of times. As such, printer units of this type must house the various mechanisms required to facilitate such reciprocating motion of the printhead, as well as conventional paper handling mechanisms. Therefore, there has typically been a trade-off between the size of the desktop printer unit and the printing speed and print quality of the printer unit, which has resulted in the lack of commercially available desktop printer units capable of printing full process colour images with at least 80% image coverage at speeds around 60 pages per minute (ppm).

The Applicant has developed a printhead that is capable of producing images having a resolution as high as 1600 dpi. Such a printhead is a pagewidth printhead and extends across the media being printed to eject drops onto the surface of the media as it is progressed past. In this regard, the printhead is held in a stationary position as the media is progressed past and does not traverse the media, which makes higher printing speeds possible. Whilst such a printhead makes it possible to provide a printer unit capable of producing high quality print images at high speeds, there is a need to develop a printer unit capable of being situated on a desktop that can accommodate such a printhead and can deliver media past the printhead in a controlled manner to facilitate printing. Further to this, there is also a need to provide a means for servicing the printhead, in the event that the printhead requires maintenance or replacement, which can be readily performed within the framework of the desktop unit.

SUMMARY OF THE INVENTION

In one embodiment of the present invention, there is provided a printer unit comprising: a body having a media input assembly for supporting media for printing; a media output assembly for collecting printed media; and a print engine adapted to be mounted to said body and having a printhead for printing an image on said media; wherein the printhead is a pagewidth printhead and is removable from said print engine.

In one form, the printhead is provided on a cartridge which is removable from the print engine to enable easy replacement of the printhead where necessary. The cartridge may also be arranged to store one or more printing fluids for printing by the printhead. The printing fluids may be in the form of an ink or may comprise a set of coloured inks for colour printing. Equally, the printing fluids may comprise an infrared ink or a fixative which may be delivered by the printhead to facilitate setting of the ink.

The media input assembly may be a media tray which is adapted to receive one or more sheets of media for printing. The media may be in the form of a standard sheet of paper, such as A4 sized paper or photographic paper. The media tray may be inclined in a substantially vertical orientation such that the media received in the media tray is delivered to the print engine in a substantially vertical manner.

The media output assembly may comprise one or more media trays for receiving and collecting the printed media following printing by the printhead. The one or more media trays may be extendable from the body of the printer unit to accommodate variable sized media.

The print engine may comprise a cradle, which is fixedly mounted to the body of the printer unit and is adapted to receive the cartridge and support the cartridge in a printing position. The cradle may comprise a control system that controls the overall operation of the printer unit and which includes at least one SoPEC device for controlling the printhead.

The cradle may further comprise a media transport system for transporting media from the media input assembly to the media output assembly, via the printhead where the image is printed onto the surface of the media. In this regard, the cradle may have a media inlet for receiving media into the print engine which is positioned upstream of the printhead proximal to the media input assembly. In order to facilitate delivery of the printed media to the media output assembly for collection, the cradle may be provided with a media outlet positioned downstream of the printhead, proximal to the media output assembly.

The media transport system may comprise a drive roller and a pinch roller which act together to transport the media under the action of media transport motor for driving the drive roller. The media transport motor may be a brushless DC motor that is controlled by the control system to control the delivery of the media through the printer unit.

The cradle may further comprise a printhead maintenance element for performing maintenance on the printhead. The printhead maintenance element may comprise a capping surface which is movable from a non-capping position to a capping position when the printhead is not in use. The capping position may be a position whereby the capping surface is in contact with the perimeter of the printhead, thereby forming a seal around the printhead and preventing ink from drying in the printhead and blocking the ink delivery nozzles. Movement of the printhead maintenance element may be provided by the media transport motor under control of the control system.

Media may be supplied to the media inlet from the media input assembly by a media picker system which may be mounted to the body of the printer unit. The media picker system may include a picker roller driven by a picker motor for delivering the media contained within the media input assembly to the media inlet. In order to control the speed of paper delivery, the picker motor may be controlled by the control system of the cradle, to control the rate of supply of media to the print engine for printing.

Following printing, the printed media may be delivered to the media output assembly from the media outlet by a media exit mechanism. The media exit mechanism may include an exit roller and an idler element which captures the printed media and delivers the media to the media output assembly. The idler element may be one or more idler wheels in rotational contact with the exit roller or may be an idler roller which is in rotational contact with the exit roller. The exit roller may be driven by the media transport motor under control of the control system of the cradle to coordinate the removal of the printed media from the print engine. In this regard, the media exit mechanism may be mounted to the body of the printer unit adjacent the media outlet of the cradle or it may be mounted to the cradle, adjacent the media outlet.

An embodiment of a printer that incorporates features of the present invention is now described by way of example with reference to the accompanying drawings.

In a first aspect the present invention provides a printer unit comprising:

a body having a media input assembly for supporting media for printing;

a media output assembly for collecting printed media; and a print engine having a printhead for printing an image onto a surface of the media;

wherein the printhead is a pagewidth printhead and is user removable from said print engine.

Optionally the printhead is provided on a cartridge and the cartridge is removable from the print engine.

Optionally the cartridge is arranged to store one or more printing fluids for printing.

Optionally the printer is a desktop printer and the media input assembly is disposed at a first angle of inclination, and the print engine is arranged such that the printhead is at a second angle of inclination, said second angle of inclination being greater than said first angle of inclination.

Optionally the first angle of inclination is between 90° and 160°.

Optionally the first angle of inclination is between 110° and 130°.

Optionally the printhead has at least 10,000 ink delivery nozzles arranged thereon.

Optionally the printhead has at least 20,000 ink delivery nozzles arranged thereon.

Optionally the printhead has at least 50,000 ink delivery nozzles arranged thereon.

Optionally the print engine further comprises a control system for operative control of the printhead, and printhead has a plurality of ink ejection nozzles arranged thereon for ejecting individual drops of ink onto a surface of the media such that during use the control system determines whether a nozzle ejects a drop of ink at a rate of at least 50 million determinations per second.

Optionally the control system determines whether a nozzle ejects a drop of ink at a rate of at least 100 million determinations per second.

Optionally the control system determines whether a nozzle ejects a drop of ink at a rate of at least 300 million determinations per second.

Optionally the control system determines whether a nozzle ejects a drop of ink at a rate of at least 1 billion determinations per second.

Optionally the print engine further comprises a control system for operative control of the printhead, and the printhead has a plurality of ink ejection nozzles arranged thereon for ejecting individual drops of ink onto a surface of the media, such that during use, the printing speed is controlled to provide a printing speed to printer weight ratio of at least 0.5 ppm/kg.

Optionally the printing speed is controlled to provide a printing speed to printer weight ratio of at least 1 ppm/kg.

Optionally the printing speed is controlled to provide a printing speed to printer weight ratio of at least 2 ppm/kg.

Optionally the printing speed is controlled to provide a printing speed to printer weight ratio of at least 5 ppm/kg.

Optionally the print engine further comprises a control system for controlling the printing speed of the printhead, and the printhead has a plurality of ink ejection nozzles arranged thereon for ejecting individual drops of ink onto a surface of the media, such that during use, the printing speed is controlled to provide a printing speed to printer volume ratio of at least 0.002 ppm/$cm^3$.

Optionally the printing speed is controlled to provide a printing speed to printer volume ratio of at least 0.005 ppm/$cm^3$.

Optionally the printing speed is controlled to provide a printing speed to printer volume ratio of at least 0.01 ppm/$cm^3$.

Optionally the printing speed is controlled to provide a printing speed to printer unit volume ratio of at least 0.02 ppm/$cm^3$.

Optionally the print engine further comprises a control system for controlling the printing speed of the printhead, and the printhead has a plurality of ink ejection nozzles arranged thereon for ejecting individual drops of ink onto a surface of the media, such that in use, the printing speed is controlled to provide an area print speed of at least 50 $cm^2$/sec.

Optionally the printing speed is controlled to provide an area print speed of at least 100 $cm^2$/sec.

Optionally the printing speed is controlled to provide an area print speed of at least 200 $cm^2$/sec.

Optionally the printing speed is controlled to provide an area print speed of at least 500 $cm^2$/sec.

Optionally the media input assembly is a media tray adapted to receive one or more sheets of media for printing.

Optionally the media is paper.

Optionally the media tray is inclined in a substantially vertical orientation.

Optionally the media output assembly comprises one or more media trays for receiving and collecting media following printing by said printhead.

Optionally the one or more media trays are extendable from said body to accommodate variable sized print media.

Optionally the print engine comprises a cradle, the cradle being fixedly mounted to said body and adapted to receive the cartridge and support the cartridge in a printing position.

Optionally the cradle includes a control system that controls the overall operation of the printer.

Optionally the control system includes at least one SoPEC device.

Optionally the cradle comprises a media transport system, the media transport system transports media from the media input assembly to the media output assembly, via the printhead.

Optionally the cradle has a media inlet for receiving media into the print engine, said media inlet positioned upstream of the printhead proximal to the media input assembly.

Optionally the cradle has a media outlet for delivering printed media from the print engine, said media outlet positioned downstream of the printhead, proximal to the media output assembly.

Optionally the media transport system comprises a drive roller and a pinch roller which act together to transport the media.

Optionally the media transport system comprises a media transport motor for driving the drive roller.

Optionally the media transport motor is a brushless DC motor.

Optionally the media transport motor is controlled by the control system which controls operation of the media transport system.

Optionally the cradle comprises a printhead maintenance element.

Optionally the printhead maintenance element has a capping surface which is adapted to cap the printhead.

Optionally the printhead maintenance element is movable from a non-capping position to a capping position.

Optionally the capping position is a position wherein the capping surface is in contact with the perimeter of the printhead, thereby forming a seal around said printhead.

Optionally the movement of the printhead maintenance element is provided by the media transport motor under control of the control system.

Optionally the media is supplied to the media inlet from the media input assembly by a media picker system.

Optionally the media picker system is mounted to the body and includes a picker roller for delivering the media contained within the media input assembly to the media inlet.

Optionally the media picker system has a picker motor that drives said picker roller.

Optionally the picker motor is controlled by the control system of the cradle, to control the rate of supply of media to the print engine for printing.

Optionally the printed media is delivered to the media output assembly from the media outlet by a media exit mechanism.

Optionally the media exit mechanism includes an exit roller and an idler element which captures the printed media and delivers the media to the media output assembly.

Optionally the idler element is one or more idler wheels in rotational contact with the exit roller.

Optionally the idler element is an idler roller which is in rotational contact with the exit roller.

Optionally the exit roller is driven by media transport motor under control of the control system of the cradle.

Optionally the media exit mechanism is mounted to said body adjacent the media outlet of the cradle.

Optionally the media exit mechanism is mounted to said cradle adjacent the media outlet.

DETAILED DESCRIPTION OF PREFERRED EMBODIMENTS

As shown in FIGS. 4-16, the present invention is embodied in a desktop printer unit 2, capable of printing photo quality images at high speeds in the range of 60 pages per minute (ppm). It should be appreciated that within the following detailed description and claims, all references to printing speeds and ppm, will refer to pages printed with full process colour images (not spot colour) and requiring at least 80% image coverage of the page. As such, all comparisons with existing printer units are based upon this printing requirement.

As will be readily understood from the following detailed description, the printer unit 2 is constructed to be of a size and weight that permits the unit to be easily supported on a standard home or office desk environment whilst occupying minimal desk space.

Figure 1:
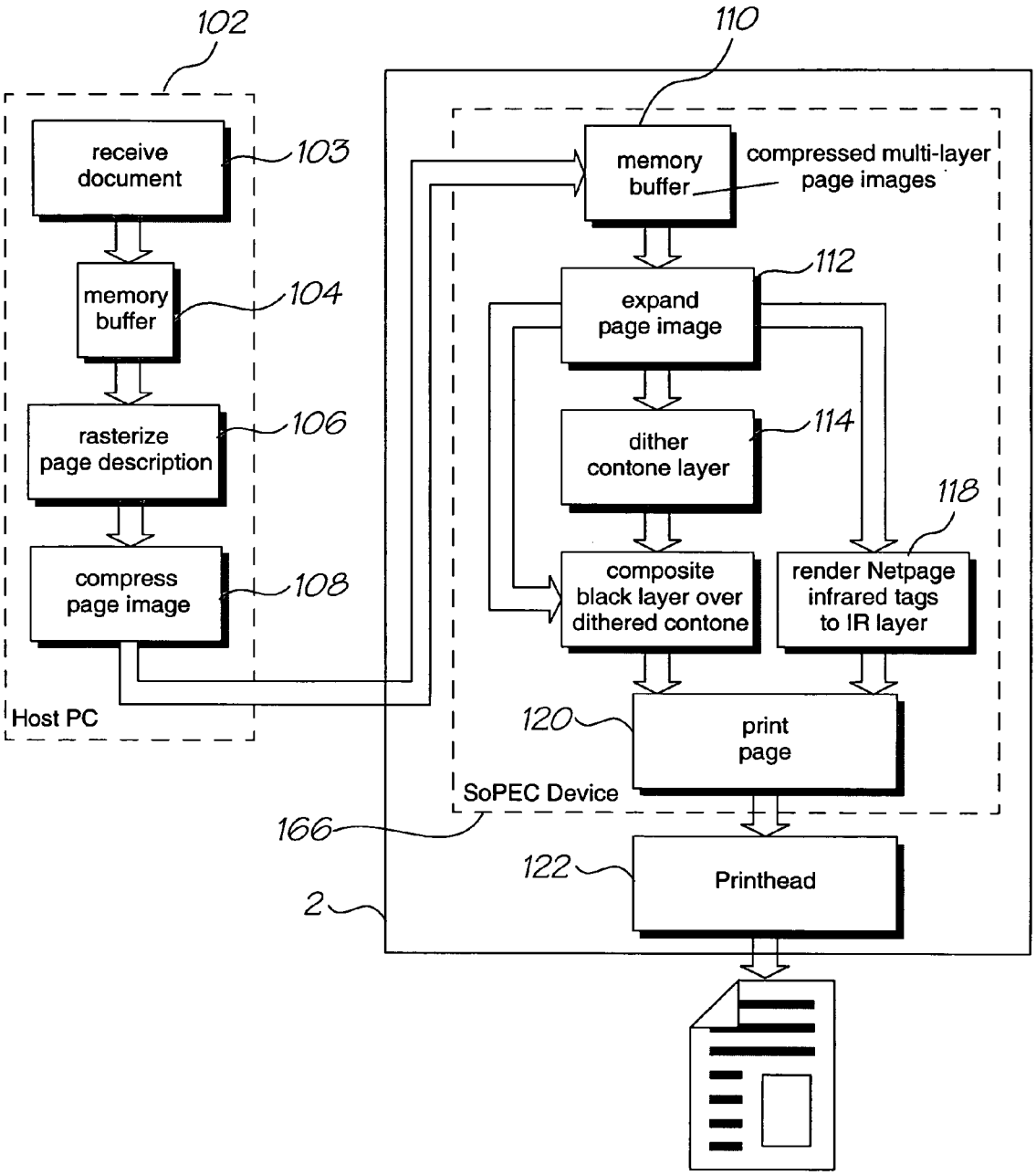
FIG. 1 shows a schematic of document data flow in a printing system according to one embodiment of the present invention.

As shown schematically in FIG. 1, in use, the printer unit 2 is arranged to print documents received from an external source, such as a computer system 102, onto a print media, such as a sheet of paper. In this regard, the printer unit 2 includes means which allow electrical connection between the unit 2 and the computer system 102, the manner in which will be described later, to receive data which has been pre-processed by the computer system 102. In one form, the external computer system 102 is programmed to perform various steps involved in printing a document, including receiving the document (step 103), buffering it (step 104) and rasterizing it (step 106), and then compressing it (step 108) for transmission to the printer unit 2.

The printer unit 2 according to one embodiment of the present invention, receives the document from the external computer system 102 in the form of a compressed, multi-layer page image, wherein control electronics 72 provided within the printer unit 2 buffers the image (step 110), and then expands the image (step 112) for further processing. The expanded contone layer is dithered (step 114) and then the black layer from the expansion step is composited over the dithered contone layer (step 116). Coded data may also be rendered (step 118) to form an additional layer, to be printed (if desired) using an infrared ink that is substantially invisible to the human eye. The black, dithered contone and infrared layers are combined (step 120) to form a page that is supplied to a printhead for printing (step 122).

In this particular arrangement, the data associated with the document to be printed is divided into a high-resolution bi-level mask layer for text and line art and a medium-resolution contone color image layer for images or background colors. Optionally, colored text can be supported by the addition of a medium-to-high-resolution contone texture layer for texturing text and line art with color data taken from an image or from flat colors. The printing architecture generalises these contone layers by representing them in abstract "image" and "texture" layers which can refer to either image data or flat color data. This division of data into layers based on content follows the base mode Mixed Raster Content (MRC) mode as would be understood by a person skilled in the art. Like the MRC base mode, the printing architecture makes compromises in some cases when data to be printed overlap. In particular, in one form all overlaps are reduced to a 3-layer representation in a process (collision resolution) embodying the compromises explicitly.

Figure 2:
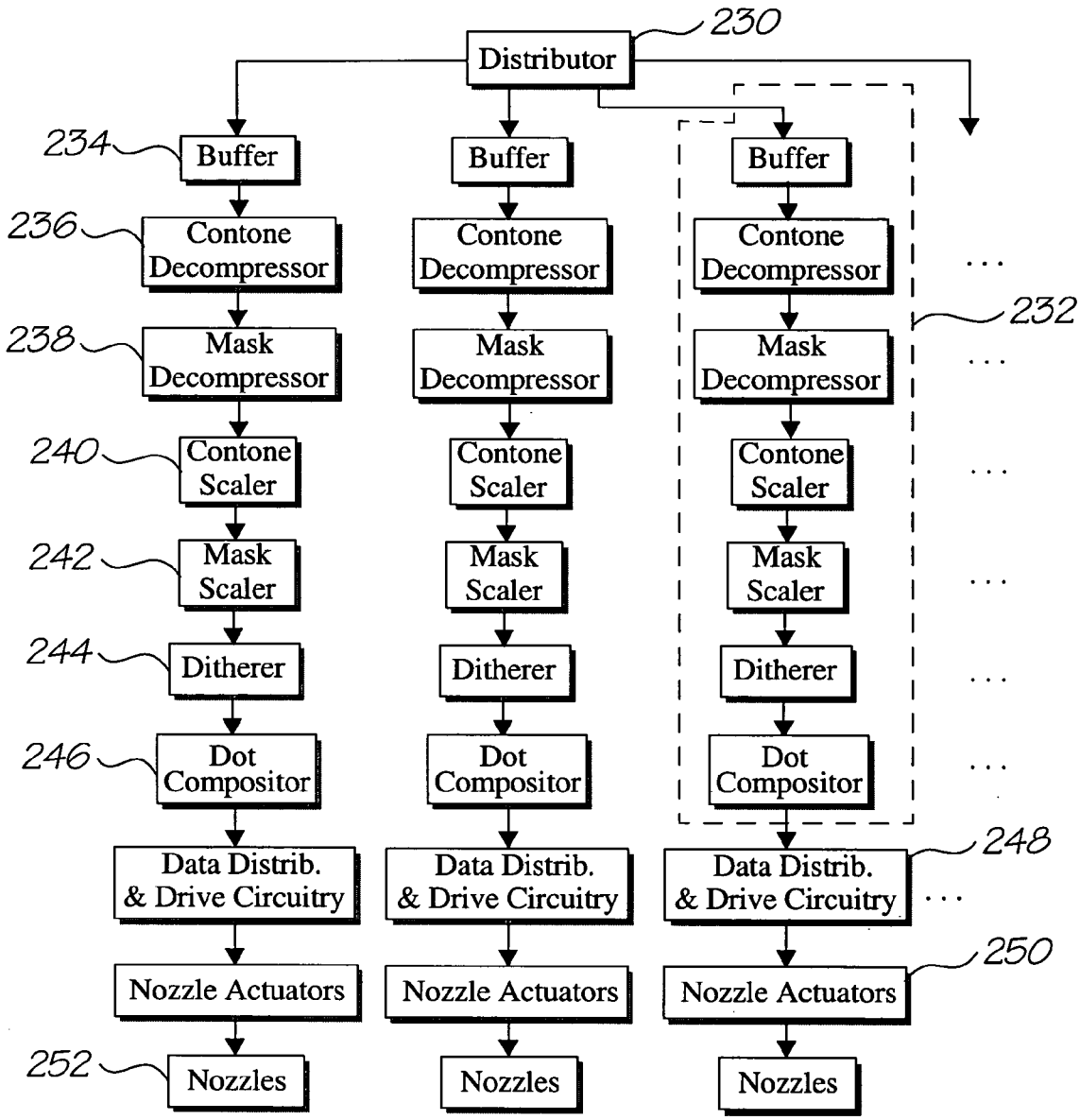
FIG. 2 shows a more detailed schematic showing an architecture used in the printing system of FIG. 1.

As mentioned previously, data is delivered to the printer unit 2 in the form of a compressed, multi-layer page image with the pre-processing of the image performed by a mainly software-based computer system 102. In turn, the printer unit 2 processes this data using a mainly hardware-based system as is shown in more detail in FIG. 2.

Upon receiving the data, a distributor 230 converts the data from a proprietary representation into a hardware-specific representation and ensures that the data is sent to the correct hardware device whilst observing any constraints or requirements on data transmission to these devices. The distributor 230 distributes the converted data to an appropriate one of a plurality of pipelines 232. The pipelines are identical to each other, and in essence provide decompression, scaling and dot compositing functions to generate a set of printable dot outputs.

Each pipeline 232 includes a buffer 234 for receiving the data. A contone decompressor 236 decompresses the color contone planes, and a mask decompressor decompresses the monotone (text) layer. Contone and mask scalers 240 and 242 scale the decompressed contone and mask planes respectively, to take into account the size of the medium onto which the page is to be printed.

The scaled contone planes are then dithered by ditherer 244. In one form, a stochastic dispersed-dot dither is used. Unlike a clustered-dot (or amplitude-modulated) dither, a dispersed-dot (or frequency-modulated) dither reproduces high spatial frequencies (i.e. image detail) almost to the limits of the dot resolution, while simultaneously reproducing lower spatial frequencies to their full color depth, when spatially integrated by the eye. A stochastic dither matrix is carefully designed to be relatively free of objectionable low-frequency patterns when tiled across the image. As such, its size typically exceeds the minimum size required to support a particular number of intensity levels (e.g. 16×16×8 bits for 257 intensity levels).

The dithered planes are then composited in a dot compositor 246 on a dot-by-dot basis to provide dot data suitable for printing. This data is forwarded to data distribution and drive electronics 248, which in turn distributes the data to the correct nozzle actuators 250, which in turn cause ink to be ejected from the correct nozzles 252 at the correct time in a manner which will be described in more detail later in the description.

As will be appreciated, the components employed within the printer unit 2 to process the image for printing depend greatly upon the manner in which data is presented. In this regard it may be possible for the printer unit 2 to employ additional software and/or hardware components to perform more processing within the printer unit 2 thus reducing the reliance upon the computer system 102. Alternatively, the printer unit 2 may employ fewer software and/or hardware components to perform less processing thus relying upon the computer system 102 to process the image to a higher degree before transmitting the data to the printer unit 2.

Figure 3:
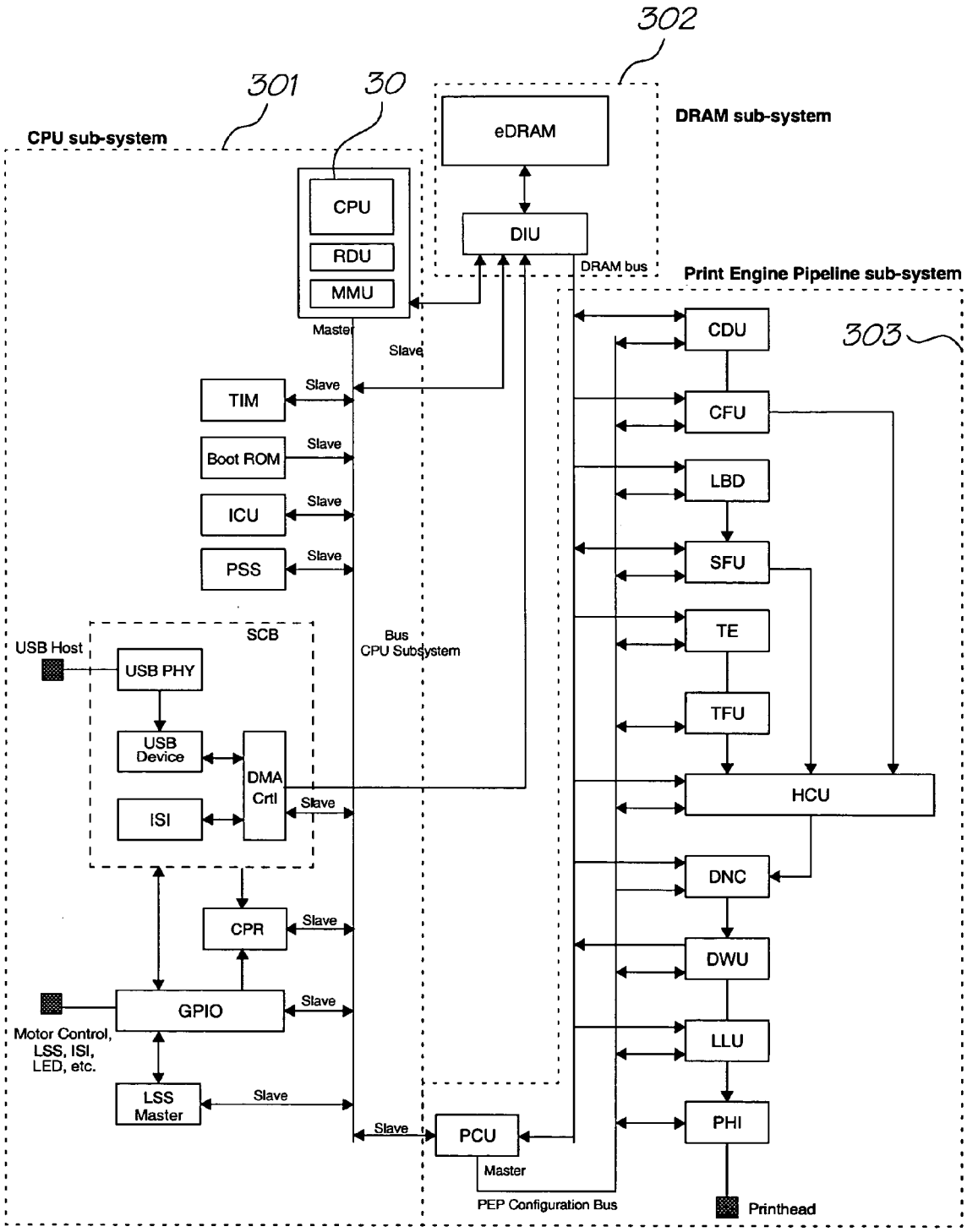
FIG. 3 shows a block diagram of an embodiment of the control electronics as used in the printing system of FIG. 1.

In all situations, the components necessary to perform the above mentioned tasks are provided within the control electronics 72 of the printer unit 2, and FIG. 3 provides a block representation of an embodiment of this electronics.

In this arrangement, the hardware pipelines 232 are embodied in a Small Office Home Office Printer Engine Chip (SoPEC). As shown, a SoPEC device consists of 3 distinct subsystems: a Central Processing Unit (CPU) subsystem 301, a Dynamic Random Access Memory (DRAM) subsystem 302 and a Print Engine Pipeline (PEP) subsystem 303.

The CPU subsystem 301 includes a CPU 30 that controls and configures all aspects of the other subsystems. It provides general support for interfacing and synchronizing all elements of the printer unit 2, as will be described later. It also controls the low-speed communication to QA chips (which are described delow). The CPU subsystem 301 also contains various peripherals to aid the CPU, such as General Purpose Input Output (GPIO, which includes motor control), an Interrupt Controller Unit (ICU), LSS Master and general timers. The Serial Communications Block (SCB) on the CPU subsystem provides a full speed USB1.1 interface to the host as well as an Inter SoPEC Interface (ISI) to other SoPEC devices (not shown).

The DRAM subsystem 302 accepts requests from the CPU, Serial Communications Block (SCB) and blocks within the PEP subsystem. The DRAM subsystem 302, and in particular the DRAM Interface Unit (DIU), arbitrates the various requests and determines which request should win access to the DRAM. The DIU arbitrates based on configured parameters, to allow sufficient access to DRAM for all requestors. The DIU also hides the implementation specifics of the DRAM such as page size, number of banks and refresh rates.

The Print Engine Pipeline (PEP) subsystem 303 accepts compressed pages from DRAM and renders them to bi-level dots for a given print line destined for a printhead interface (PHI) that communicates directly with the printhead. The first stage of the page expansion pipeline is the Contone Decoder Unit (CDU), Lossless Bi-level Decoder (LBD) and, where required, Tag Encoder (TE). The CDU expands the JPEG-compressed contone (typically CMYK) layers, the LBD expands the compressed bi-level layer (typically K), and the TE encodes any Netpage tags for later rendering (typically in IR or K ink), in the event that the printer unit 2 has Netpage capabilities. The output from the first stage is a set of buffers: the Contone FIFO unit (CFU), the Spot FIFO Unit (SFU), and the Tag FIFO Unit (TFU). The CFU and SFU buffers are implemented in DRAM.

The second stage is the Halftone Compositor Unit (HCU), which dithers the contone layer and composites position tags and the bi-level spot layer over the resulting bi-level dithered layer.

A number of compositing options can be implemented, depending upon the printhead with which the SoPEC device is used. Up to 6 channels of bi-level data are produced from this stage, although not all channels may be present on the printhead. For example, the printhead may be CMY only, with K pushed into the CMY channels and IR ignored. Alternatively, any encoded tags may be printed in K if IR ink is not available (or for testing purposes).

In the third stage, a Dead Nozzle Compensator (DNC) compensates for dead nozzles in the printhead by color redundancy and error diffusing of dead nozzle data into surrounding dots.

The resultant bi-level 6 channel dot-data (typically CMYK, Infrared, Fixative) is buffered and written to a set of line buffers stored in DRAM via a Dotline Writer Unit (DWU).

Finally, the dot-data is loaded back from DRAM, and passed to the printhead interface via a dot FIFO. The dot FIFO accepts data from a Line Loader Unit (LLU) at the system clock rate (pclk), while the PrintHead Interface (PHI) removes data from the FIFO and sends it to the printhead at a rate of ⅔ times the system clock rate.

In the preferred form, the DRAM is 2.5 Mbytes in size, of which about 2 Mbytes are available for compressed page store data. A compressed page is received in two or more bands, with a number of bands stored in memory. As a band of the page is consumed by the PEP subsystem 303 for printing, a new band can be downloaded. The new band may be for the current page or the next page.

Using banding it is possible to begin printing a page before the complete compressed page is downloaded, but care must be taken to ensure that data is always available for printing or a buffer under-run may occur.

The embedded USB 1.1 device accepts compressed page data and control commands from the host PC, and facilitates the data transfer to either the DRAM (or to another SoPEC device in multi-SoPEC systems, as described below).

Multiple SoPEC devices can be used in alternative embodiments, and can perform different functions depending upon the particular implementation. For example, in some cases a SoPEC device can be used simply for its onboard DRAM, while another SoPEC device attends to the various decompression and formatting functions described above. This can reduce the chance of buffer under-run, which can happen in the event that the printer commences printing a page prior to all the data for that page being received and the rest of the data is not received in time. Adding an extra SoPEC device for its memory buffering capabilities doubles the amount of data that can be buffered, even if none of the other capabilities of the additional chip are utilized.

Each SoPEC system can have several quality assurance (QA) devices designed to cooperate with each other to ensure the quality of the printer mechanics, the quality of the ink supply so the printhead nozzles will not be damaged during prints, and the quality of the software to ensure printheads and mechanics are not damaged.

Normally, each printing SoPEC will have an associated printer QA, which stores information printer attributes such as maximum print speed. An ink cartridge for use with the system will also contain an ink QA chip, which stores cartridge information such as the amount of ink remaining. The printhead also has a QA chip, configured to act as a ROM (effectively as an EEPROM) that stores printhead-specific information such as dead nozzle mapping and printhead characteristics. The CPU in the SoPEC device can optionally load and run program code from a QA Chip that effectively acts as a serial EEPROM. Finally, the CPU in the SoPEC device runs a logical QA chip (ie, a software QA chip).

Usually, all QA chips in the system are physically identical, with only the contents of flash memory differentiating one from the other.

Each SoPEC device has two LSS system buses that can communicate with QA devices for system authentication and ink usage accounting. A large number of QA devices can be used per bus and their position in the system is unrestricted with the exception that printer QA and ink QA devices should be on separate LSS busses.

In use, the logical QA communicates with the ink QA to determine remaining ink. The reply from the ink QA is authenticated with reference to the printer QA. The verification from the printer QA is itself authenticated by the logical QA, thereby indirectly adding an additional authentication level to the reply from the ink QA.

Data passed between the QA chips, other than the printhead QA, is authenticated by way of digital signatures. In the preferred embodiment, HMAC-SHAI authentication is used for data, and RSA is used for program code, although other schemes could be used instead.

As will be appreciated, the SoPEC device therefore controls the overall operation of the printer unit 2 and performs essential data processing tasks as well as synchronising and controlling the operation of the individual components of the printer unit 2 to facilitate print media handling. In the remainder of the description the term control electronics 72 will be used to refer to the SoPEC device and any other electronics which are employed within the printer unit 2 to control its operation.

FIGS. 4-16 depict an inkjet printer unit 2 which includes a main body 3, a media input assembly 4 that retains and supports print media for printing, and a media output assembly 5 that collects the print media following printing by the printer unit. The main body 3 is arranged to house a print engine 70 and associated power source 15 and control electronics 72, as well as paper handling apparatus which act to deliver the print media from the media input assembly 4 past the print engine 70 where the print media is printed, to the media output assembly 5, where the printed media is collected. Such a configuration provides a compact printer unit that can be readily used in a home or office environment to print a variety of images from single colour text to full colour photo images.

Referring to FIGS. 4-12, the structure of the main body 3 is formed by an upper frame unit 7 which is shaped to be received on a lower frame unit 6. The upper and lower frame units 7, 6 together define a base 8, a rear 9 and an opening 10 upon which a cover 11 is received. The opening 10 provides access to an internal cavity 12 which contains the print engine 70 and associated componentry.

The base 8 is formed on the underside of the lower frame unit 6 and has a lower surface 13 that supports the printer unit 2 when the printer unit is positioned on a substantially horizontal surface, such as a surface of a desk in a home or office environment. One or more foot supports 14 extend from the lower surface 13 to provide additional stability to the printer unit. The foot supports 14 are made from a friction inducing material such as rubber, to increase the frictional contact between the printer unit and the support surface.

Figure 5:
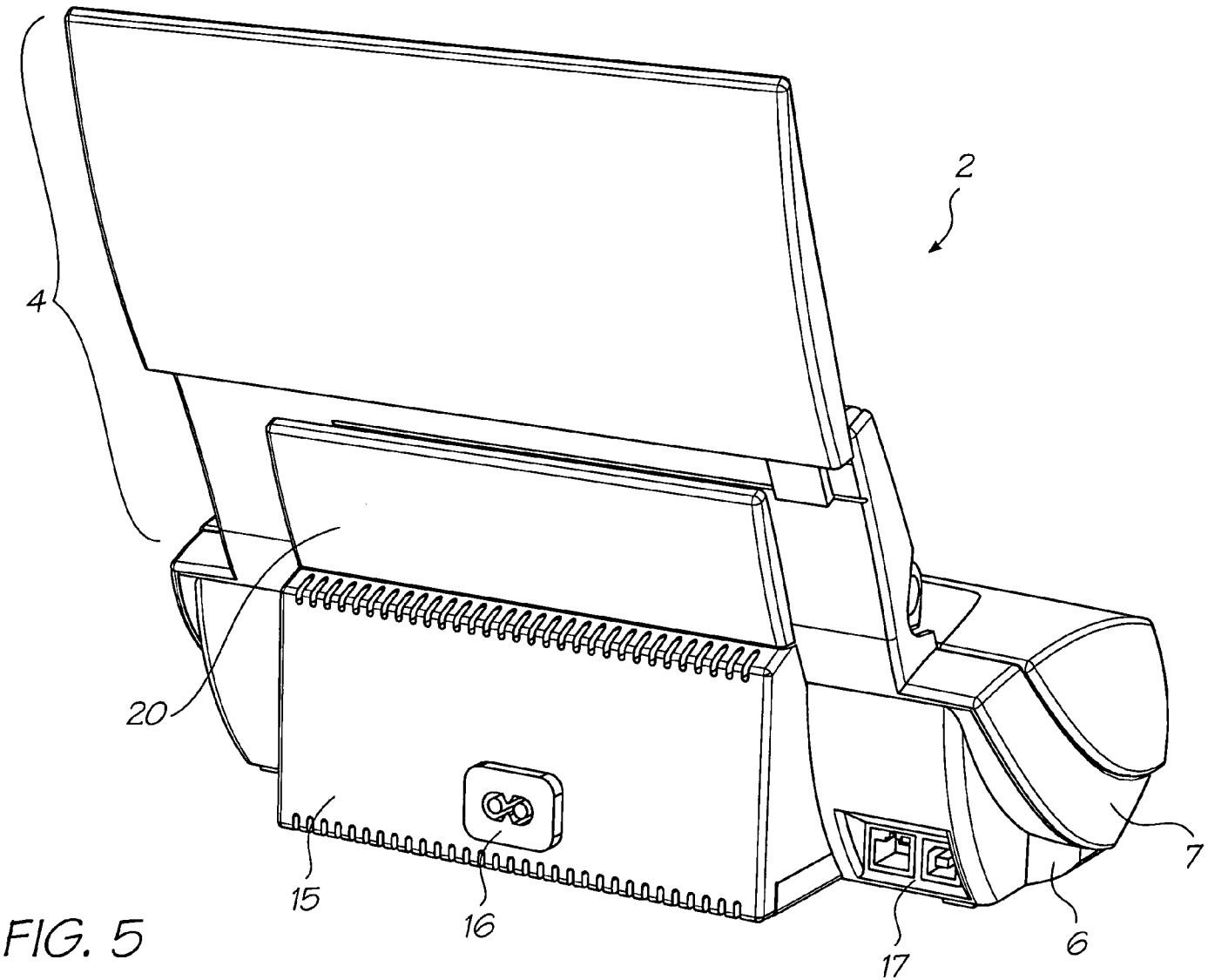
FIG. 5 shows a rear perspective view of the printer unit of FIG. 4.
Figure 6:
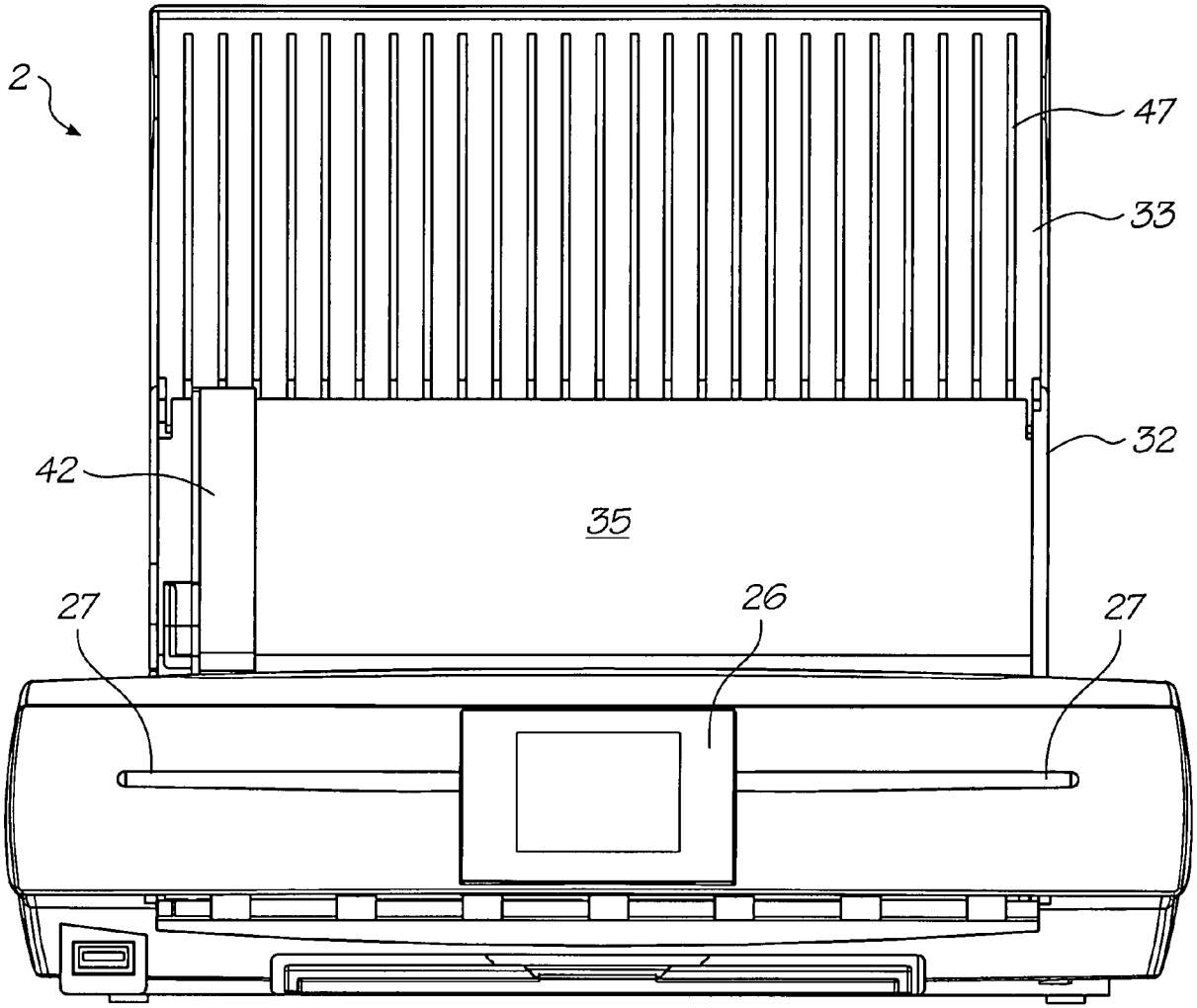
FIG. 6 shows a front plan view of the printer unit of FIG. 4.
Figure 7:
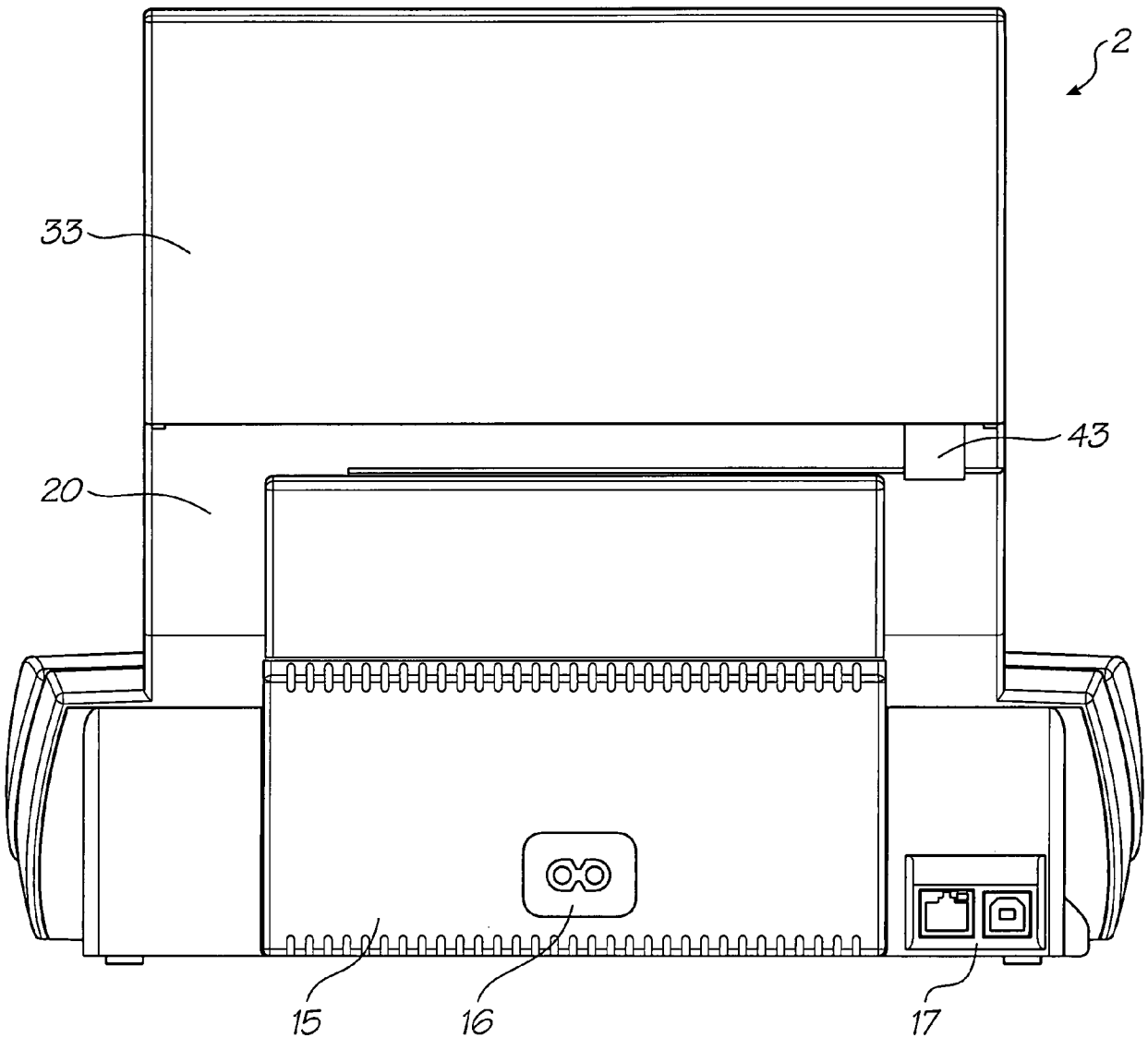
FIG. 7 shows a rear plan view of the printer unit of FIG. 4.

As shown in FIGS. 5 and 7, the rear 9 of the main body 3 is defined by the rear surface of the lower frame unit 6 and the upper frame unit 7. A power supply unit 15 forms part of the rear 9 and is shaped to fit into a recess provided in the lower frame unit 6 to supply power to the printer unit 2. The power supply unit 15 is fixedly received within the shaped recess in the lower frame unit 6, however it is also envisaged that the power supply unit 15 could be of a rechargeable type capable of storing power for supply to the printer unit 2, and as such the unit 15 would be removable from the frame unit 6 for replacement where necessary. A power connector socket 16 is provided in the power supply unit 15 for connection to an external power supply via a suitable lead (not shown). Data connector sockets 17 are also formed in the lower frame unit 6 and provide a means for connecting the printer unit 2 to an external source, such as a computer system 102, to provide data and commands to the printer unit 2 in the manner as previously described. The data connector sockets 17 are in the form of standard ethernet and USB Device sockets which enable the printer unit 2 to be connected to the computer terminal 102 or a network of computer terminals to receive data and commands therefrom. Such information may also be received by the printer unit 2 in a wireless manner by using a WIFI card 18 and/or a Bluetooth® card 19 provided under a cover plate 20 on the rear surface of the upper frame unit 7. In each of these arrangements, all data received is transmitted from the sockets 17 and cards 18, 19 to the SoPEC device of the printer unit 2 for processing in the manner previously described.

As is shown in FIGS. 4, 6, 8 and 11, the cover 11 of the main body 3 comprises a lid 21 hingedly connected to the lower frame unit 6. The lid 21 has a curved top surface 22 and an angled front surface 23 and two end surfaces 24 which are shaped to mate with the upper edge of the upper frame unit 7. The lid 21 is pivotally connected along a lower edge of the angled front surface 23 with the lower frame unit 6. This pivotal connection allows the lid 21 to be pivoted forward to provide access to the internal cavity 12 of the main body 3.

The angled front surface 23 has a recess 25 formed therein. The recess 25 receives a user interface unit 26 that enables communication between a user and the printer unit 2. The user interface unit 26 is an LCD touch screen that conveys information to the user and allows the user to directly input information to the printer unit 2 via selecting an option on the display screen. The type of information which the user interface unit 26 may display to the user and which the user may input into the printer unit can vary, however typically this can relate to the status of the ink stored in the printer unit 2, the need to correct any paperjams or the like, as well as information relating to the ink refilling procedure. The use of a touch screen LCD is particularly beneficial as a user interface, as the display can be programmed to a specific language thereby overcoming the need to provide separate markings or text on the printer unit 2 which may be specific to the country to which the printer unit is to be used. However, it should be appreciated that the user interface unit 26 could be in a number of different forms, such as conventional buttons and the like, which allow the user to interact with the printer unit 2.

The angled front surface 23 of the lid 21 is also provided with a visual indicator unit 27 which provides the user with a visual indication of the status of the printer. The visual indicator unit 27 extends along the surface of the lid 21 and is in the form of an elongated tube or panel 28 which emits light from a light source 29. The colour and/or intensity of the light emitted from the visual indicator unit 27 can be controlled in a manner that provides the user with an instant indication of the state of the printer unit 2 without the need to refer to the user interface unit 26.

Figure 17A:
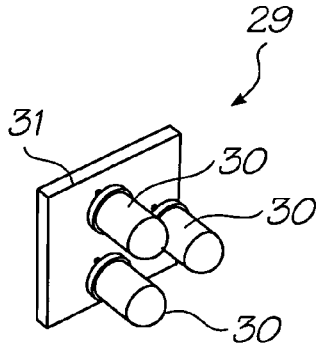
FIGS. 17*a* and 17*b* show perspective views of the components of the visual indicator unit.
Figure 17B:
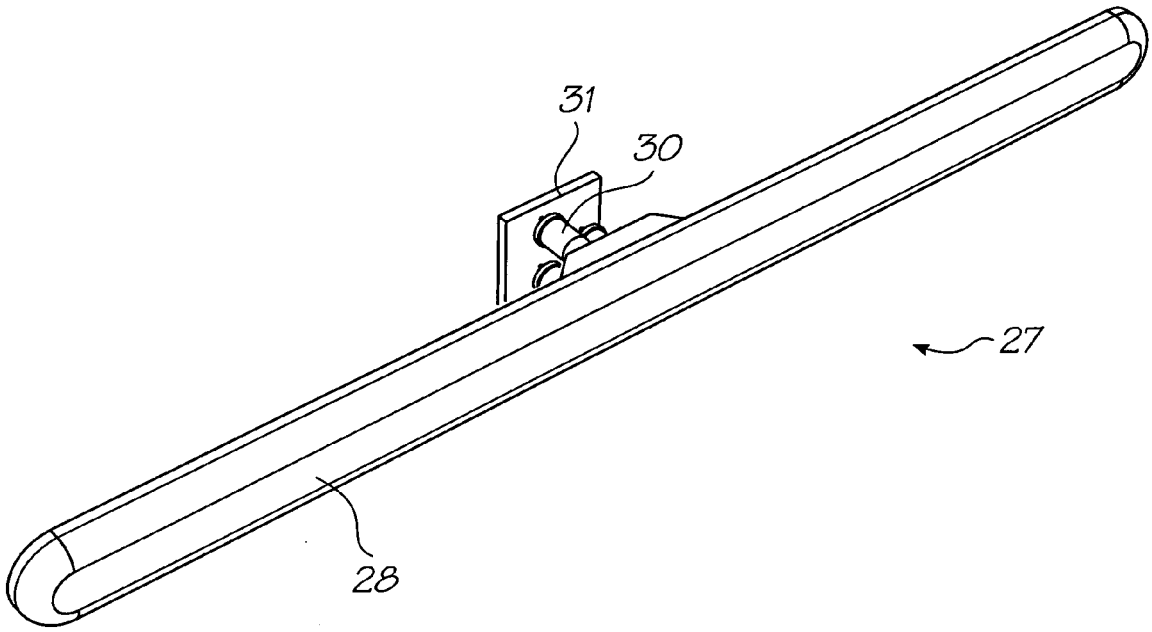

The construction of the visual indicator unit 27 is shown in FIGS. 17*a* and 17*b*. As shown, the unit 27 consists of a light source 29 and an elongate panel 28. The light source 31 is in the form of three light emitting diodes (LEDs) 30 arranged upon the surface of a printed circuit board (PCB) 31. The LEDs 30 are red, green and blue LEDs which allow a wide spectrum of light to be emitted from the panel 28. However it will be appreciated that a single LED or other colored LEDs could also be employed to perform a similar function. The PCB 31 may be the same PCB that contains the control electronics 72 for the printer unit 2 or may be a separate PCB that includes appropriate electronics to operate the LEDs 30 under control of the control electronics 72. The elongate panel 28 is made from a material that allows light from the LEDs 30 to travel along its length and to be transmitted from the surface of the panel. The panel 28 may be in the form of a hollow tube or pipe that is placed over the LEDs 30 to collect light emitted therefrom. The internal surface of the tube or pipe may be coated with a film that enables a portion of the light to be reflected along the length of the panel 28, and a portion of light to pass from the panel 28 thereby illuminating the panel 28 which can be readily seen by the user along the surface of the panel 28.

In use, each of the LEDs 30 can be controlled to emit a light from the panel 28 representative of the state of the printer unit 2. For example, to indicate to the user that the printer unit is in a standby mode a blue LED may be activated such that the panel 28 emits a blue light. During printing a green LED may be activated to emit a green light from the panel 28 and in the event of a problem such as a paper jam or a printer error, a red LED may be activated to emit a red light from the panel 28. Additionally, in order to create a decorative effect, each of the LEDs may be actuated in various combinations to emit a variety of coloured lights across a wide spectrum. As the light is emitted over a large surface area, rather then merely at a point source as is the case with a single LED provided on a printer unit, the user is more likely to visually detect the state of the printer and to attend to the printer where necessary. Such a system performs an important function in ensuring an efficient workplace and also provides a printer unit which is aesthetically pleasing.

To supply print media to the printer unit 2 for printing, the media input assembly 4 extends from the rear 9 of the printer unit 2. The media input assembly 4 consists of a tray portion 32 and a media support flap 33 which together form a surface for receiving one or more sheets of print media 34 for printing by the printer unit 2. The media input assembly 4 extends in a vertical direction from the main body 3 and is angled such that in use, the sheets of print media 34 are supported by the media input assembly 4 in a vertical orientation and are drawn into the printer via a downward path, as is shown in FIG. 16 and discussed in more detail later.

Figure 11:
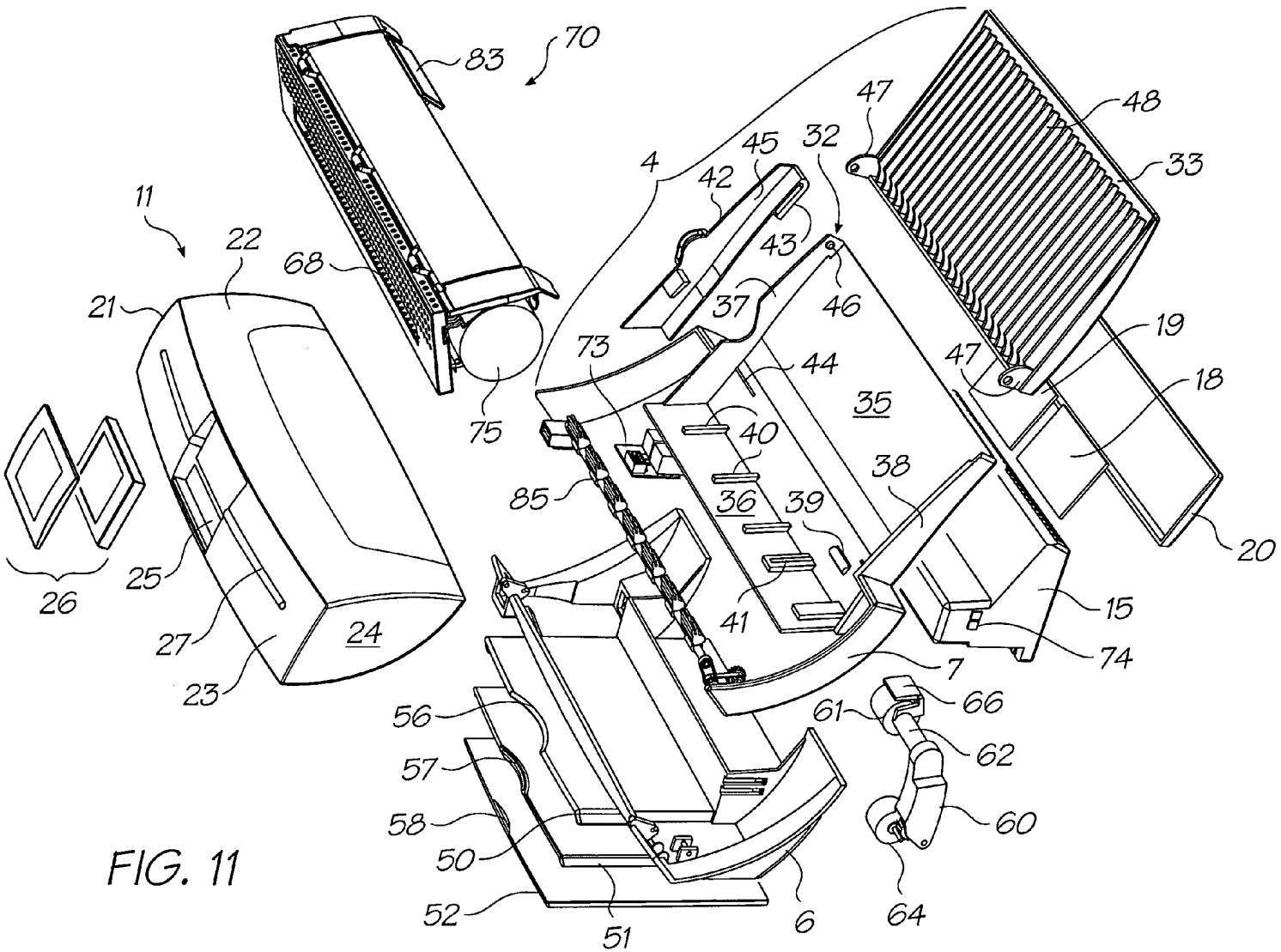
FIG. 11 shows an exploded front perspective view of the printer unit of FIG. 4.

As shown more clearly in FIG. 11, the tray portion 32 of the media input assembly 4 is formed integrally with the upper frame unit 7, and as such the rear surface of the tray portion 32 forms part of the rear 9 of the main body 3. The tray portion 32 generally forms a receptacle for receiving the print media 34 and includes a working surface 35 upon which the media 34 is placed, and a media support surface 36 at one end thereof adapted to receive an edge of the media 34 to maintain the media 34 in an upright position. The tray portion 32 also includes a pair of parallel extending side walls 37, 38 which define the maximum width of the print media that can be accommodated by the printer unit 2.

Figure 16:
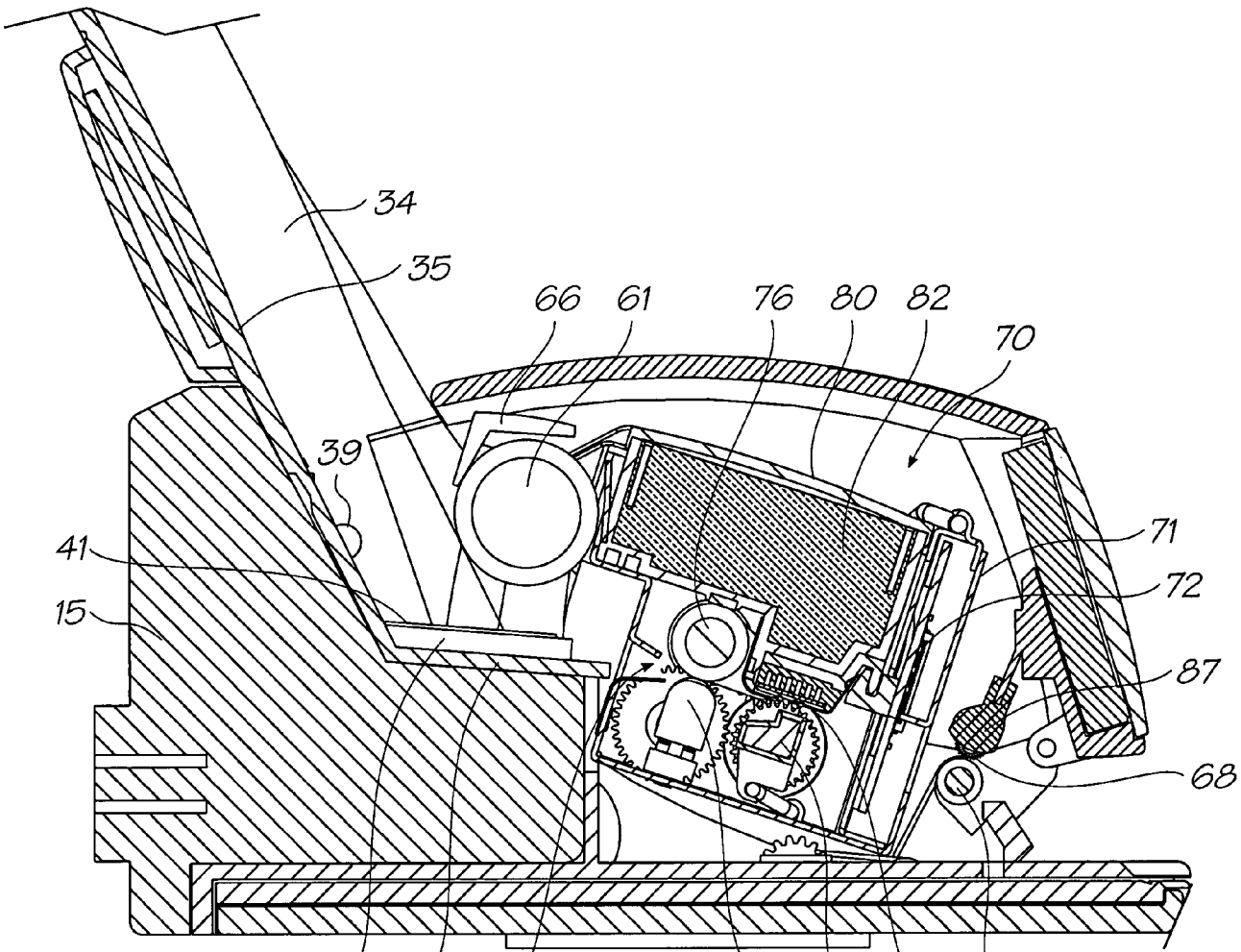
FIG. 16 shows a cross sectional view of the printer unit of FIG. 4, with the print engine orientated with respect to the media input assembly.

As is shown more clearly in FIG. 16, the media support surface 36 is disposed at an obtuse angle to the working surface 35 of the tray portion 32, to aid in the delivery of a sheet of print media from the tray portion 32 to the print engine 70 for printing. The working surface 35 has an idler roller 39 incorporated therein to act with a picker mechanism 60 to facilitate the delivery of a sheet of print media 34 from the working surface 35 to the print engine for printing. Disposed at intervals along the media support surface 36 are a number of raised strips 40 which extend from the media support surface 36 and support the leading edge of the media 34 above the surface 36. The strips 40 act to allow the leading edge of the media 34 to slide along the surface of the strips 40 under action of the picker mechanism 60 to facilitate delivery of the media 34 from the tray portion 32. A pad 41 is provided on the surface of the strip 40 adjacent the picker mechanism 60 to provide a friction surface to facilitate separation of the upper most sheet of media 10 when a plurality of sheets are supported upon the working surface 35 of the tray portion 32. The pad 41 may be in the form of a rubber, felt or cork type material.

A margin slider 42 is adapted to be fitted over the working surface 35 of the tray portion 32 via an integral hook element 43. A grooved recess 44 is provided in the working surface 35 to receive a locating lug (not shown) of the slider 42. Such an arrangement allows the slider 42 to be moved in a controlled manner across the surface 35 to accommodate print media 34 of varying widths. The margin slider 42 extends the height of the tray portion 32 and is provided with a wall portion 45 that extends out from the working surface 35 of the tray portion 32 to abut against a side edge of the print media 34. This arrangement ensures that the print media 34 is properly aligned within the tray portion 32 to ensure controlled delivery of the sheets of media to the print engine 70.

As shown in FIG. 11, the side walls 37, 38 of the tray portion 32 are provided with locating lugs 46 on the inner surfaces thereof to enable the media support flap 33 to be connected to the tray portion 32. In this regard, the media support flap 33 includes a pair of recessed tabs 47 extending from an end thereof that receives the lugs 46 thereby securing the media support flap 33 to the upper end of tray portion 32 as shown in FIG. 1. With this arrangement, the media support flap 33 can pivot about the distal end of the tray portion 32 such that the flap 33 can be moved to an extended position to support print media 34 loaded onto the media input assembly 4 (as shown in FIG. 4), or into a retracted position for packaging or shipment, wherein the media support flap 33 is received on top of the tray portion 32 (not shown).

Figure 8:
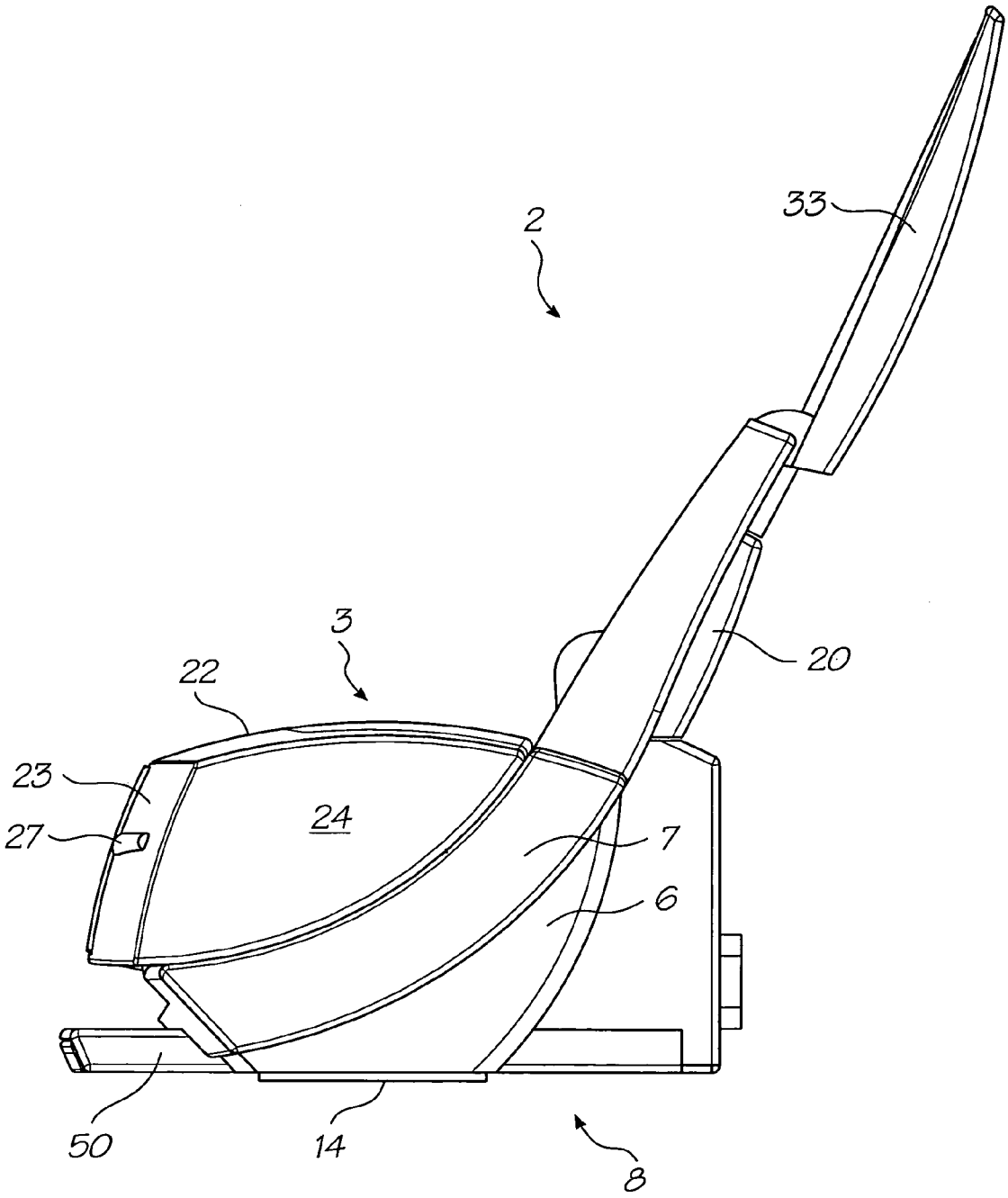
FIG. 8 shows a right hand side view of the printer unit of FIG. 4.

The media support flap 33 extends beyond the distal end of the tray portion 32 to support print media 34 having a length greater than the length of the tray portion 32. This arrangement ensures that the print media 34 is maintained in a substantially upright position, as shown in FIG. 8. In this regard, the surface of the media support flap 33 is provided with a plurality of equispaced fin elements 48 that extending longitudinally along the surface of the flap 33. Each of the fin elements 48 extend from the surface of the media support flap 35 an equal amount to thereby present a flat surface to the print media 34 which is continuous with the working surface 35 of the tray portion 32. It is envisaged that the inner surface of the media support flap 33 could also be a continuous moulded surface with appropriate slots formed in edge regions thereof to accommodate the side walls 37, 38 of the tray portion 32, when the media support flap 33 is folded for packaging or transport of the printer unit 2.

Figure 4:
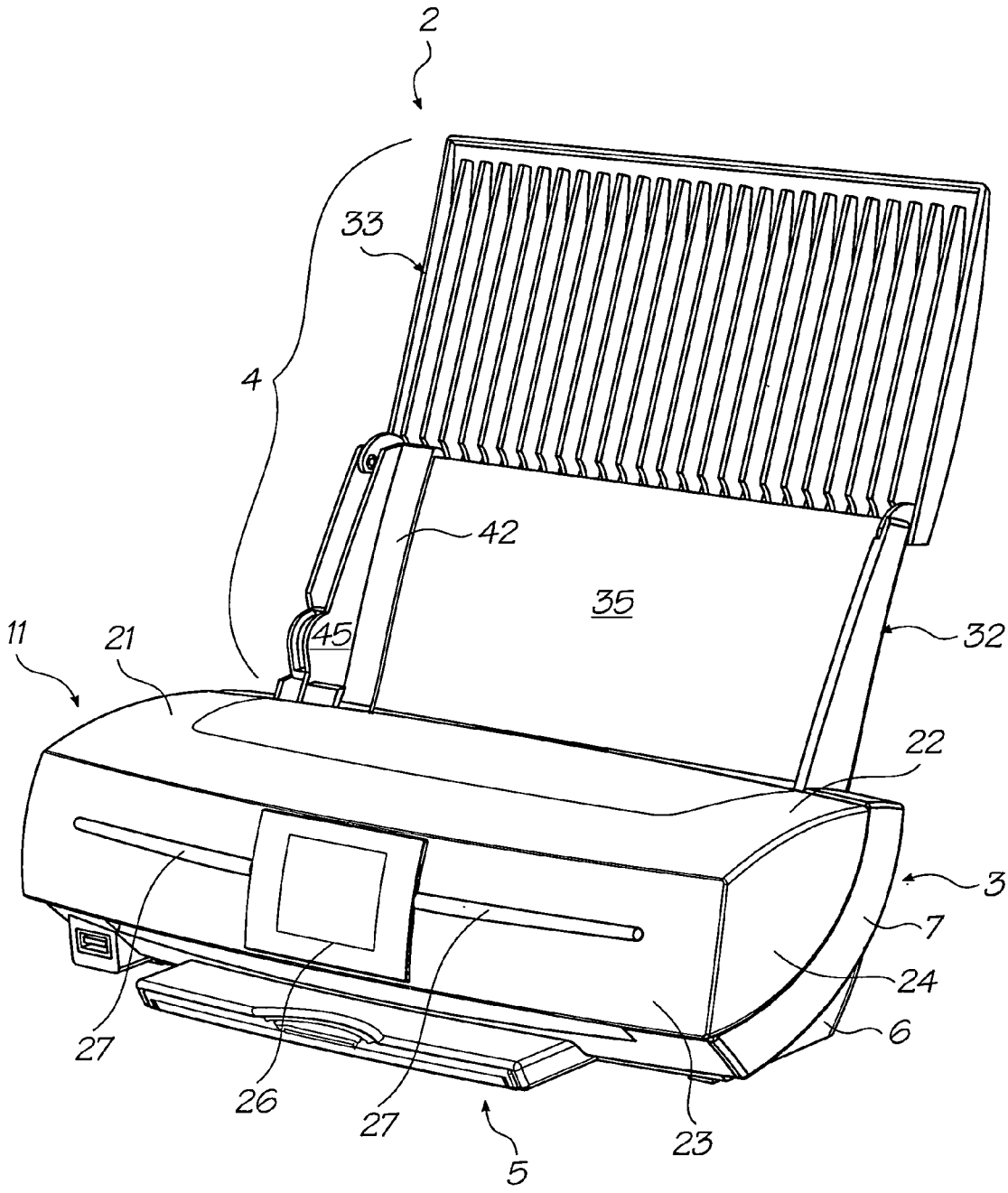
FIG. 4 shows a front perspective view of a printer unit according to a preferred embodiment of the present invention.

Printed media is collected by the media output assembly 5, as shown in FIG. 4, which is positioned in the base 8 of the main body 3 at the front of the printer unit 2. The media output assembly 5 consists of a tray housing 50 and two extendible output trays, and upper output tray 51 and a lower output tray 52, both of which are retained within the tray housing 50 when not in an extended position.

Figure 10:
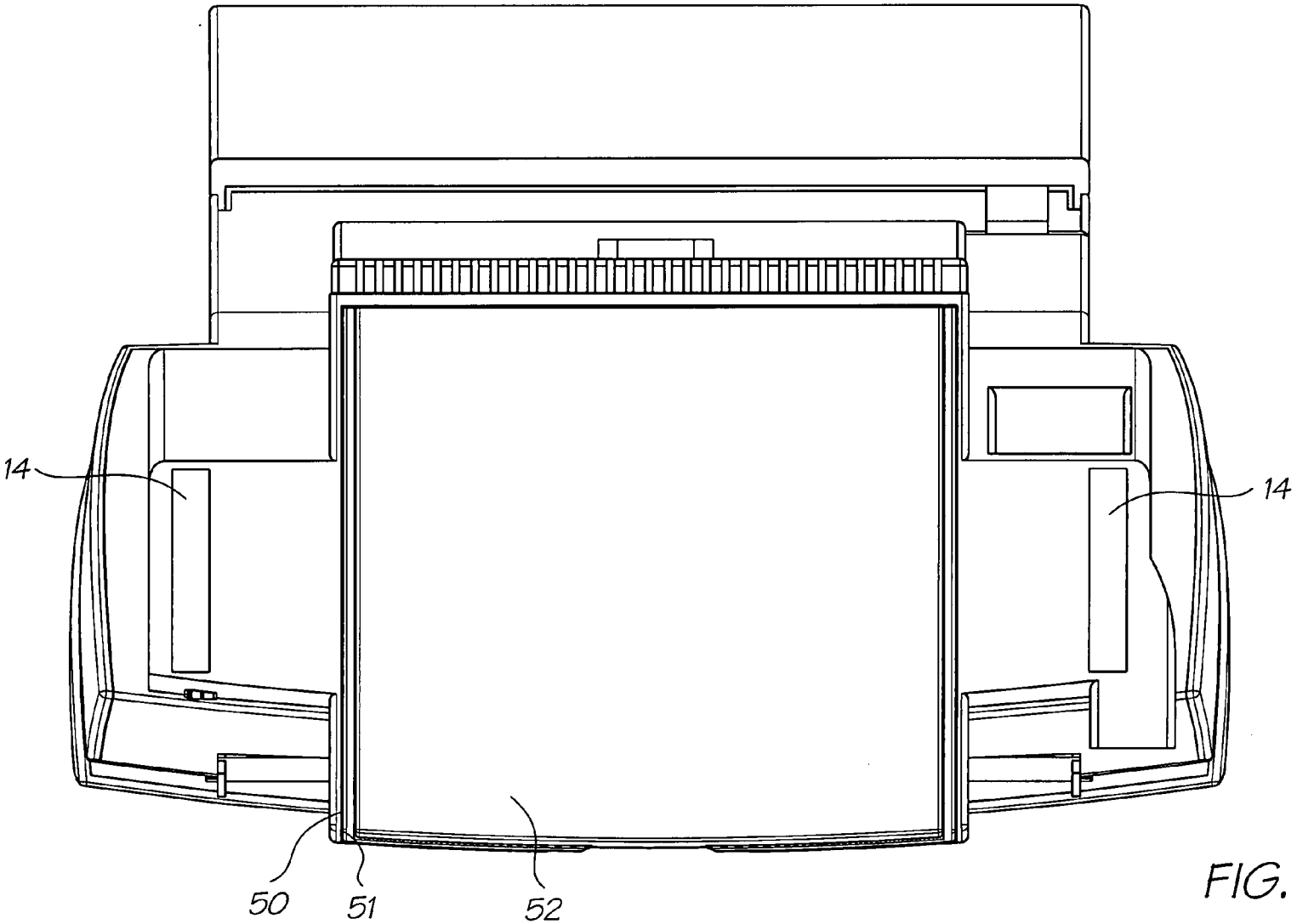
FIG. 10 shows a bottom plan view of the printer unit of FIG. 4.

As shown in FIGS. 10 and 11, the tray housing 50 is formed integral with the lower frame unit 6, and extends from the rear to marginally beyond the front of the printer unit 2. The tray housing 50 has an upper surface 53 and two side walls 54, 55 extending downwardly from the upper surface 53. The front edge of the upper surface 53 is open and has a recessed portion 56 formed therein to enable access to the upper and lower output trays 51, 52 retained within the tray housing 50.

The upper output tray 51 is shaped to be received and retained within the tray housing 50 by the two side walls 54, 55. The two side walls 54, 55 have grooves (not shown) provided therein that extend the length of the tray housing 50. The upper output tray 51 is sized to be received with the grooves such that its longitudinal edges travel within the grooves to allow the tray 51 to move relative to the tray housing 50. The grooves and the longitudinal edges of the upper output tray 51 are arranged such that the tray 51 is extendible from the tray housing 50, but is not removable from the tray housing 50. In this arrangement the tray 51 when in its retracted position, fits entirely within the tray housing 50.

Figure 9:
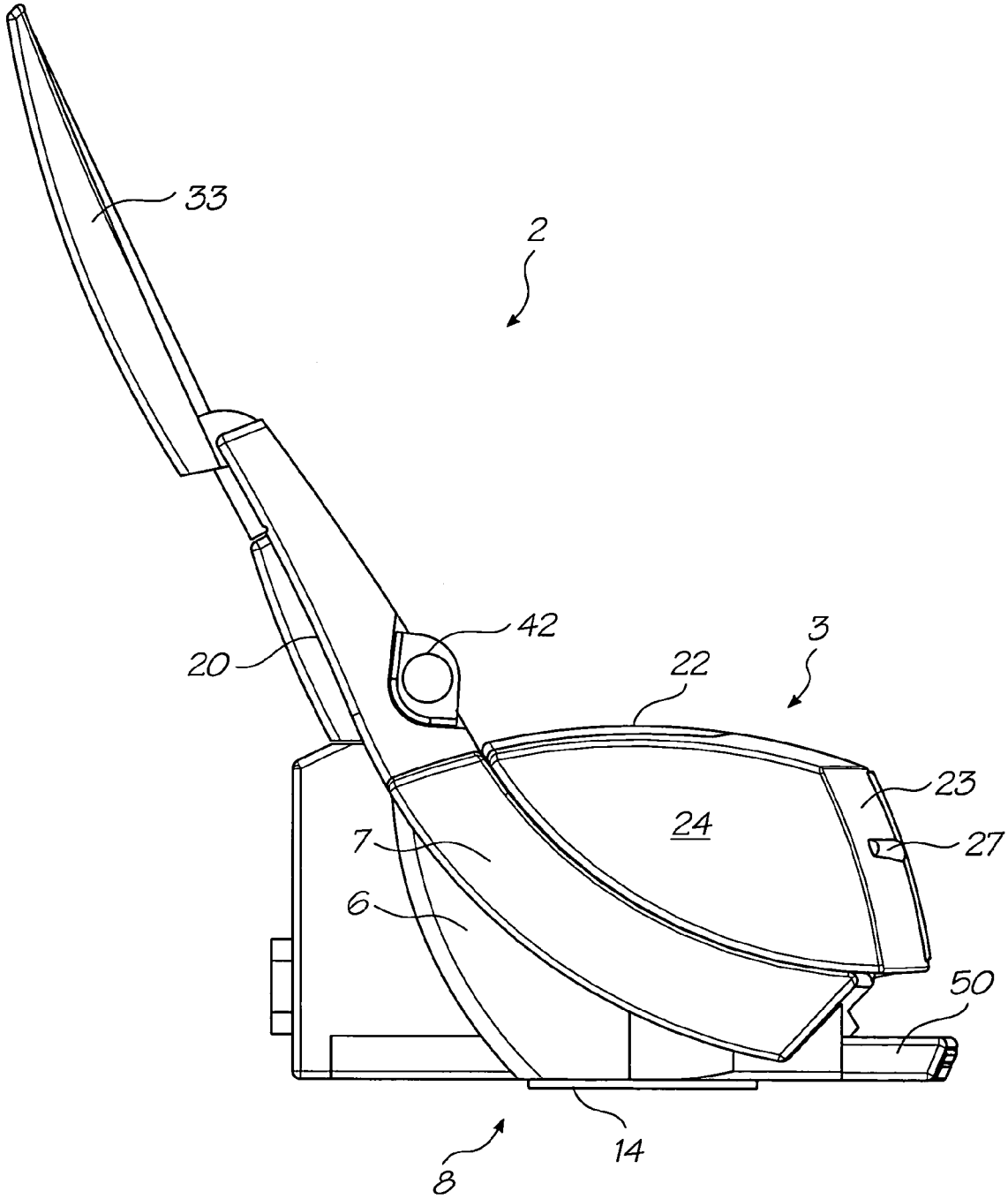
FIG. 9 shows a left hand side view of the printer unit of FIG. 4.

The lower output tray 52 is constructed in a similar manner to the upper output tray 51. However in this arrangement, the lower output tray 52 is received within two grooves provided in the longitudinal edges of the upper output tray 51. As is shown in FIG. 9, the lower output tray 52 has a reduced width and thickness than the upper output tray 51 to allow the lower tray 52 to travel within the upper tray. The lower output tray 52 is arranged to fit entirely within the upper output tray 51 in a retracted state and the upper output tray 51 is also provided with a recessed portion 57 along its front edge thereof to enable access to a stop member 58 provided on the front edge of the lower output tray 52. The lower output tray 52 and the upper output tray 51 may also be configured in a manner which allows the lower tray 52 to be extended from the upper tray 51 but prevented from being removed from the upper tray, in a similar manner as described above. Other arrangements of the trays which permit retraction and extension are also possible and would be considered to fall within the scope of the present invention.

Figure 12:
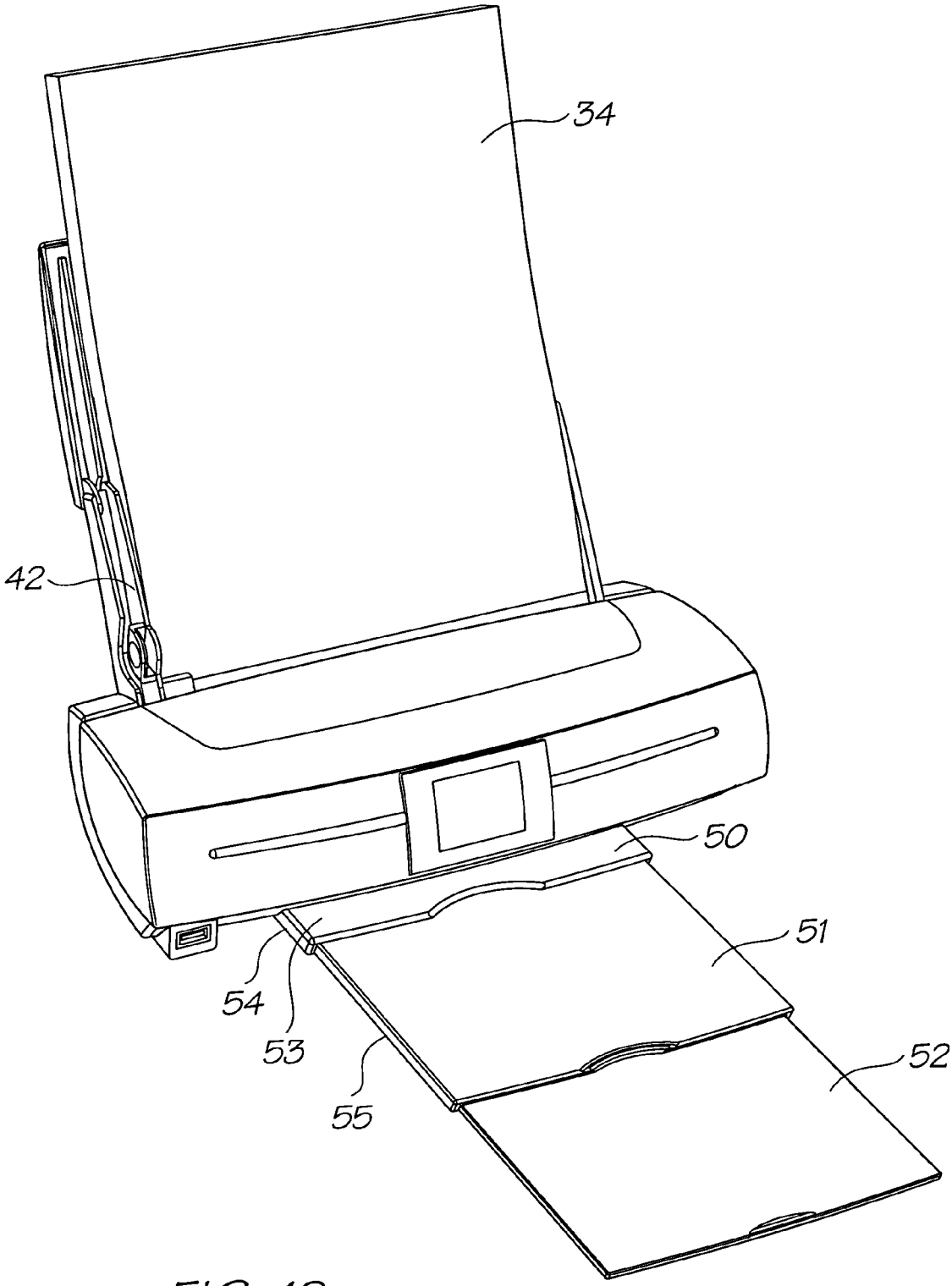
FIG. 12 shows a front perspective view of the printer unit of FIG. 4 with the media out put assembly in an extended position and media loaded into the media input assembly.

Prior to use, the media output assembly 5 is in a retracted state as shown in FIG. 4. The media output assembly 5 is brought into an operational position, as shown in FIG. 12, when a user grips the stop member 58 and extends the lower output tray 52. This action causes the entire media output assembly 5 to extend from the tray housing 50 to capture the printed media ejected from the printer unit 2. The leading edge of the printed media is captured upon contacting the stop member 58 of the lower output tray 52 following exiting the main body 3. The amount by which the media output assembly 5 is extended is dependant upon the size of the media being printed. For example, if the print media is of a length such as that shown in FIG. 12, such as A4 sized media, then the print media assembly 5 may need to be fully extended in order to capture and retain the printed media.

As is shown in FIG. 10, and as mentioned previously, access to the internal cavity 12 of the main body 3 is possible by pivoting the lid 21 of the cover 11 forwards. The internal cavity 12 receives the print engine 70 as well as the paper handling mechanisms in the form of a picker mechanism 60 and paper exit mechanism.

As alluded to previously, the purpose of the picker mechanism 60 is to separate and transport single sheets of print media from the media input assembly 4 for delivery to the print engine 70 for printing. As the printer unit 2 can operate at speeds up to, and in excess of, 60 ppm the picker unit is configured to separate and transport sheets of print media to the print engine 70 at a rate suitable for achieving these printing speeds. As such, the picker mechanism 60 consists of a picker roller 61 which is disposed at the end of an arm 62 that extends from the picker body 63. The picker body 63 contains a motor 64 which is controlled by the control electronics 72 of the printer unit 2. The picker body 63 is pivotally mounted to the lower frame unit 6 via a mounting 65. In this arrangement the picker mechanism 60 is able to move about the mounting 65 and is spring loaded such that the picker roller 61 is urged towards the working surface 35 of the tray portion 32.

In the absence of print media 34 in the tray portion 32, the picker roller 61 is urged into contact with the idler roller 39 provided on the working surface 35 of the tray portion 32. In order to load print media into the tray portion 32, media 34 is inserted into the tray portion 32 and contacts a guide element 66 provided over the picker roller 61. This contact causes the picker mechanism 60 to pivot away from the working surface 35 of the tray portion 32, and allows the print media to be received between the picker roller 61 and the idler roller 39, with the leading edge of the print media 34 supported on the media support surface 36. This arrangement is shown in FIG. 16.

The surface of the picker roller 61 is provided with a gripping means, which may be in the form of a rubber coating or other similar type coating or surface treatment which facilitates gripping of the roller to a sheet of print media 34. As the picker roller 61 rotates, under action of the motor 64, the sheet of print media in contact with the picker roller 61 is caused to slide along the raised strips 40 for delivery to the print engine 70. The outermost sheet is separated from the other sheets present in the tray portion 32 due to the pad 41 provided on the surface of the strip 40 adjacent the picker mechanism 60. In this regard, any sheets of media that move with the outermost sheet will experience a friction force as they slide over the pad 41 which is greater than the friction force causing the motion, and as such only the outermost sheet will be delivered to the print engine 70.

It will be appreciated that the picker mechanism 60 is employed to separate the print media 34 and to transport individual sheets of print media, at relatively high speeds, to the print engine 70 for printing and as such the type of picker mechanism 60 employed to perform this function could vary and still fall within the scope of the present invention.

The print engine assembly 70 employed by the present invention is generally comprised of two parts: a cradle unit 71 and a cartridge unit 80. In this arrangement, the cartridge unit 80 arranged to be received within the cradle unit 71.

As shown variously in FIGS. 11, 13-16, the cartridge unit 80 has a body that houses a printhead integrated circuit 81 for printing on a sheet of print media 34 as it passes thereby. The body of the cartridge unit 80 also houses ink handling and storage reservoirs 82 for storing and delivering ink to the printhead integrated circuit 81. The printhead integrated circuit 81 is a pagewidth printhead integrated circuit that is disposed along the outside of the body of the cartridge in a region below the ink handling and storage reservoirs 82 to extend the width of the media 34 being printed. As opposed to conventional printer units, the printhead integrated circuit 81 of the present invention is fixed in position during operation and does not scan or traverse across the print media. As such the print engine of the present invention is able to achieve far higher printing speeds than is currently possible with conventional printer systems.

Power and data signals are provided from the control electronics 72 located on the cradle unit 71 to control the operation of the printhead integrated circuit 81. The control electronics 72 includes the previously described SoPEC device and signals are transmitted from the control electronics 72 to the cartridge unit 80 via data and power connectors (not shown) provided on the periphery of the body of the cartridge unit 80. Upon inserting the cartridge unit 80 into the cradle unit 71, the data and power connectors mate with corresponding data and power connectors provided on the cradle unit 71, thereby facilitating power and data communication between the units 71, 80.

Figure 15:
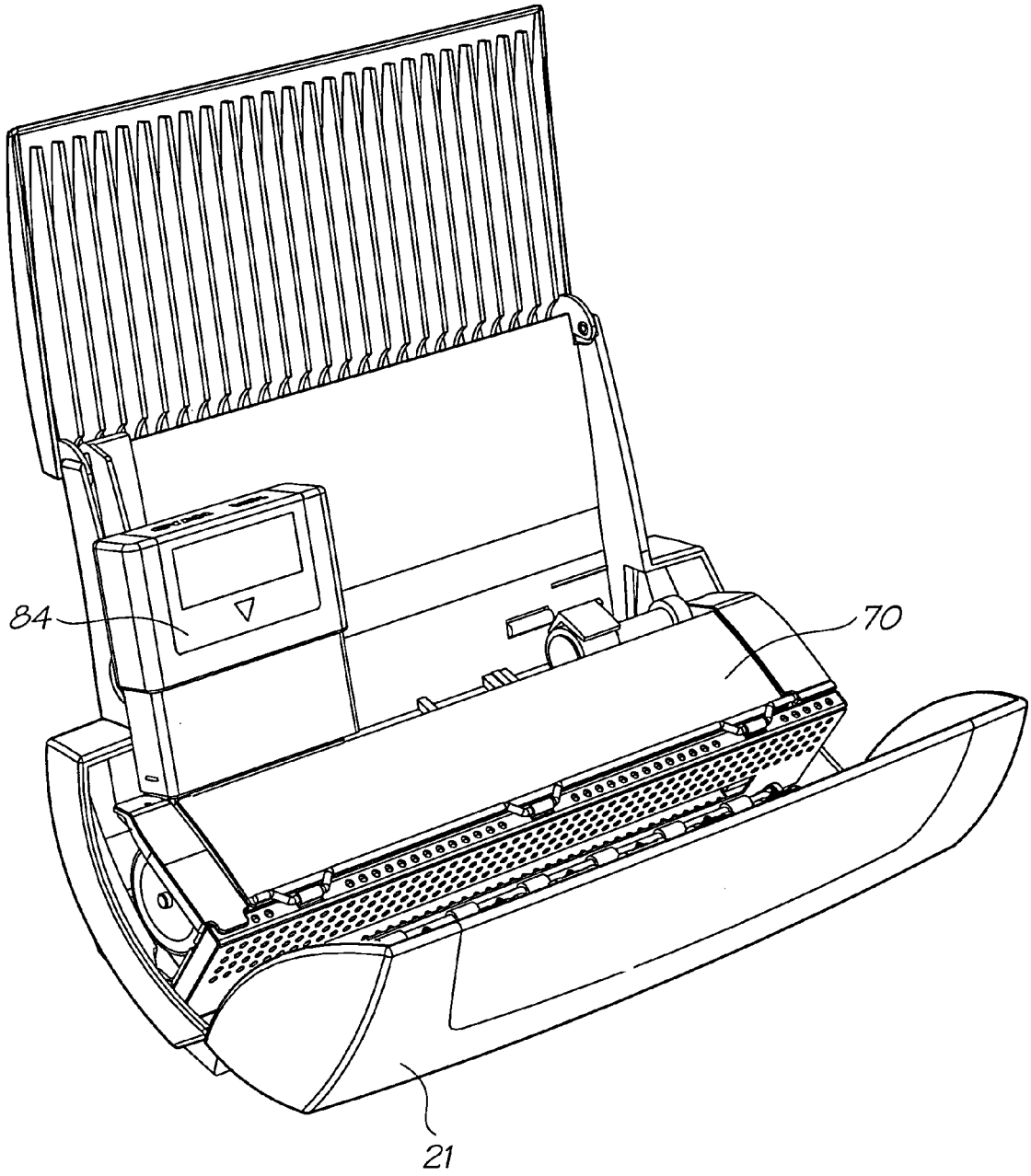
FIG. 15 shows a front perspective view of the printer unit of FIG. 13, with the print cartridge being refilled.

The ink handling and storage reservoirs 82 are in the form of a plurality of polyethylene membrane pockets that separately store different types of inks and printing fluids for printing. For example, the cartridge unit 80 may be provided with six separate polyethylene membrane reservoirs for storing cyan, magenta, yellow and black ink for full colour printing as well as infra-red ink for specific printing applications and an ink fixative to aid in the setting of the ink. Each or the reservoirs 82 are in fluid communication with a corresponding inlet provided in a refill port 83 formed on the periphery of the body of the cartridge unit 80. As such, the reservoirs 82 are able to be individually refilled by bringing an ink refill dispenser 84 into contact with the refill port 83 and delivering ink under pressure into the reservoirs 82 as is shown in FIG. 15. As mentioned previously, the ink refill dispenser 84 may be equipped with a QA chip which is read by a corresponding reader provided on the body of the cartridge unit 80. The associated data is then transmitted to the SoPEC device provided in the control electronics 72 of the cradle unit 71 to ensure the integrity and quality of the refill fluid. To facilitate refilling, the polyethylene membrane reservoirs 82 are configured such that as they fill they expand to accommodate the fluid and as the ink/fluid is consumed during the printing process the reservoir collapses.

Ink and printing fluids stored within the reservoirs 82 are delivered to the printhead integrated circuit 81 via a series of conduits arranged to carry a specific fluid, such as a particular colour ink or fixative, and to allow the fluid to be distributed to the correct ink delivery nozzle provided along the length of the printhead integrated circuit 81. The manner in which this is achieved and the general construction of the cartridge unit 80 has been described in the present Applicant's United States patent applications Filing Docket Nos. RRA01US to RRA33US, the disclosures of which are all incorporated herein by reference. The above applications have been identified by their filing docket number, which will be substituted with the corresponding application number, once assigned.

As mentioned above, the printhead integrated circuit 81 of the cartridge unit 80 is a pagewidth printhead integrated circuit which is configured to extend a width of around 22.4 cm (8.8 inches) to accommodate print media of a variable width up to around 21.6 cm, which is equivalent to media having the width of standard A4 or US letter form. It is also envisaged however, that the pagewidth printhead integrated circuit may also be fabricated to have a greater or lesser width, dependant greatly upon the application of the printer unit 2 and the type of print media used. In order to achieve the desired width, the printhead integrated circuit 81 may be made up of a one or more adjacently mounted integrated circuits with each integrated circuit having a plurality of ink delivery nozzles provided thereon.

Figure 26:
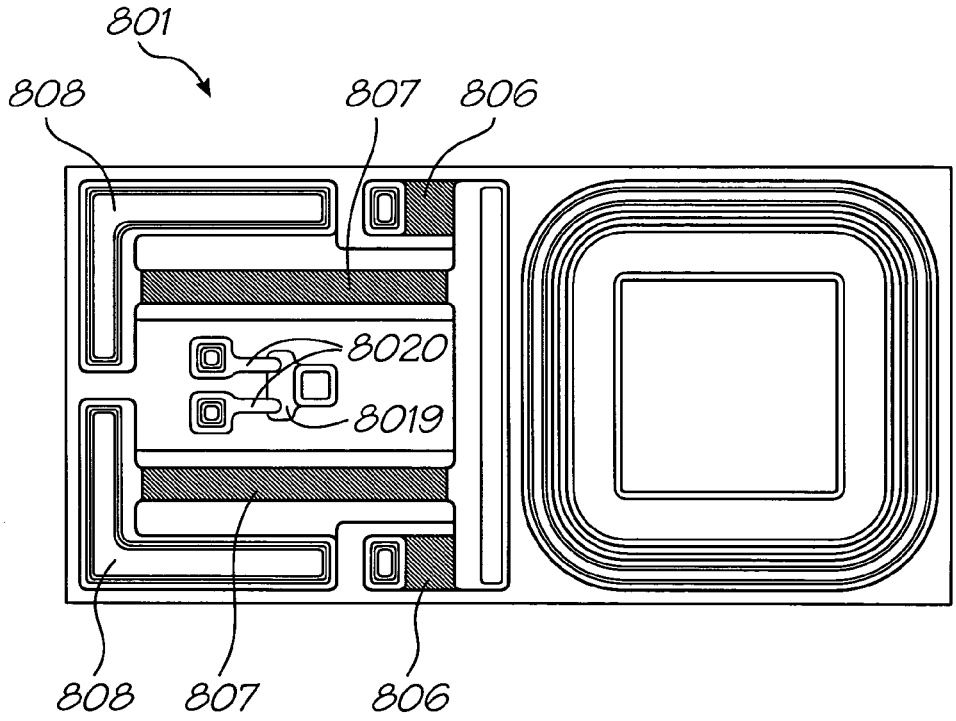
FIG. 26 shows a plan view of the nozzle of FIG. 18 with the lever arm and movable nozzle removed for clarity.
Figure 27:
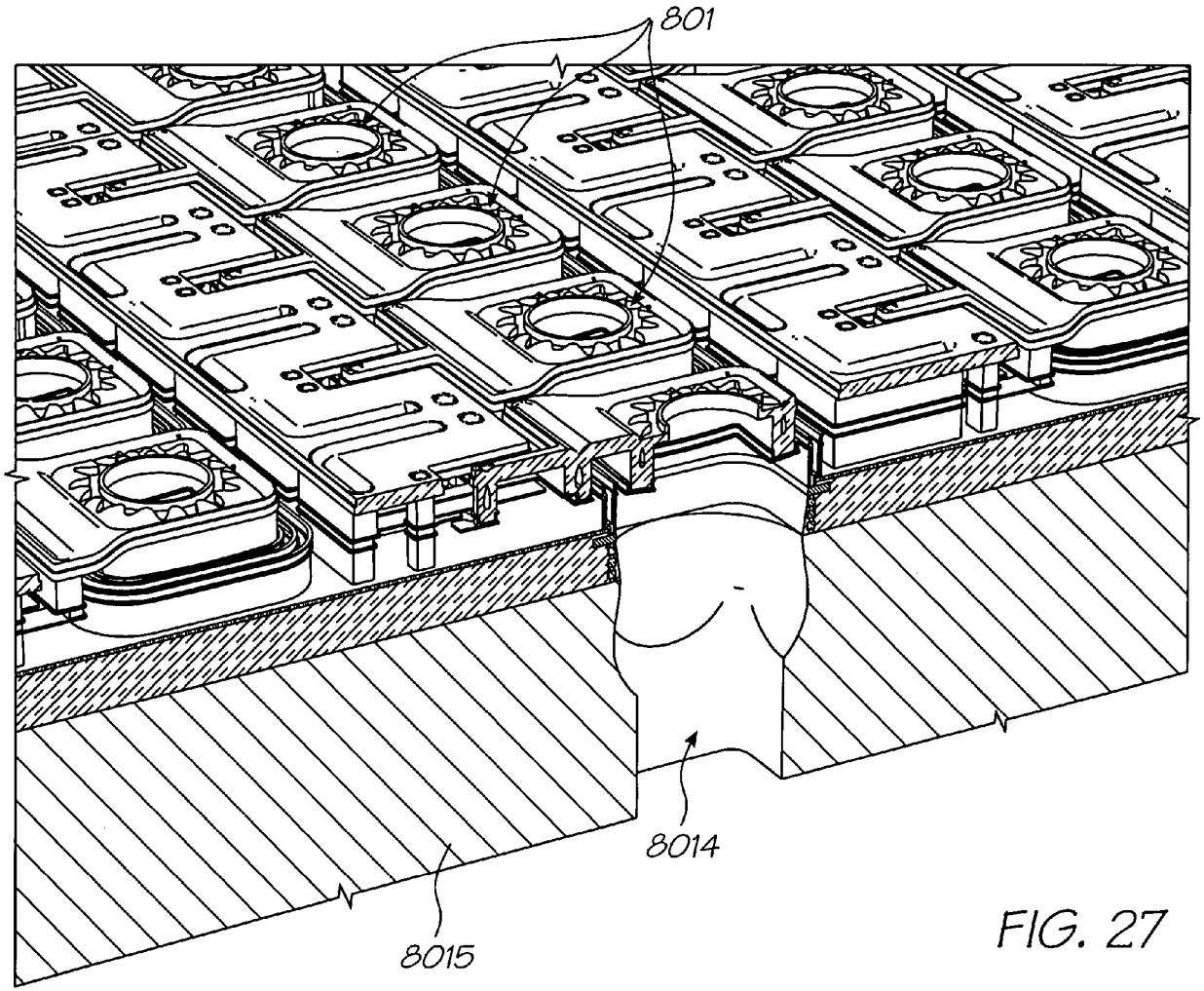
FIG. 27 shows a perspective vertical sectional view of a part of a printhead chip incorporating a plurality of the nozzle arrangements of the type shown in FIG. 18.

An example of a type of printhead nozzle arrangement suitable for the present invention, comprising a nozzle and corresponding actuator, will now be described with reference to FIGS. 18 to 27. FIG. 27 shows an array of the nozzle arrangements 801 formed on a silicon substrate 8015. Each of the nozzle arrangements 801 are identical, however groups of nozzle arrangements 801 are arranged to be fed with different colored inks or fixative. In this regard, the nozzle arrangements are arranged in rows and are staggered with respect to each other, allowing closer spacing of ink dots during printing than would be possible with a single row of nozzles. Such an arrangement makes it possible to provide the density of nozzles as described above. The multiple rows also allow for redundancy (if desired), thereby allowing for a predetermined failure rate per nozzle.

Each nozzle arrangement 801 is the product of an integrated circuit fabrication technique. In particular, the nozzle arrangement 801 defines a micro-electromechanical system (MEMS).

For clarity and ease of description, the construction and operation of a single nozzle arrangement 801 will be described with reference to FIGS. 18 to 26.

The ink jet printhead chip 81 includes a silicon wafer substrate 8015 having 0.35 Micron 1 P4M 12 volt CMOS microprocessing electronics is positioned thereon.

A silicon dioxide (or alternatively glass) layer 8017 is positioned on the substrate 8015. The silicon dioxide layer 8017 defines CMOS dielectric layers. CMOS top-level metal defines a pair of aligned aluminium electrode contact layers 8030 positioned on the silicon dioxide layer 8017. Both the silicon wafer substrate 8015 and the silicon dioxide layer 8017 are etched to define an ink inlet channel 8014 having a generally circular cross section (in plan). An aluminium diffusion barrier 8028 of CMOS metal 1, CMOS metal ⅔ and CMOS top level metal is positioned in the silicon dioxide layer 8017 about the ink inlet channel 8014. The diffusion barrier 8028 serves to inhibit the diffusion of hydroxyl ions through CMOS oxide layers of the drive electronics layer 8017.

A passivation layer in the form of a layer of silicon nitride 8031 is positioned over the aluminium contact layers 8030 and the silicon dioxide layer 8017. Each portion of the passivation layer 8031 positioned over the contact layers 8030 has an opening 8032 defined therein to provide access to the contacts 8030.

The nozzle arrangement 801 includes a nozzle chamber 8029 defined by an annular nozzle wall 8033, which terminates at an upper end in a nozzle roof 8034 and a radially inner nozzle rim 804 that is circular in plan. The ink inlet channel 8014 is in fluid communication with the nozzle chamber 8029. At a lower end of the nozzle wall, there is disposed a moving rim 8010, that includes a moving seal lip 8040. An encircling wall 8038 surrounds the movable nozzle, and includes a stationary seal lip 8039 that, when the nozzle is at rest as shown in FIG. 10, is adjacent the moving rim 8010. A fluidic seal 8011 is formed due to the surface tension of ink trapped between the stationary seal lip 8039 and the moving seal lip 8040. This prevents leakage of ink from the chamber whilst providing a low resistance coupling between the encircling wall 8038 and the nozzle wall 8033.

Figure 25:
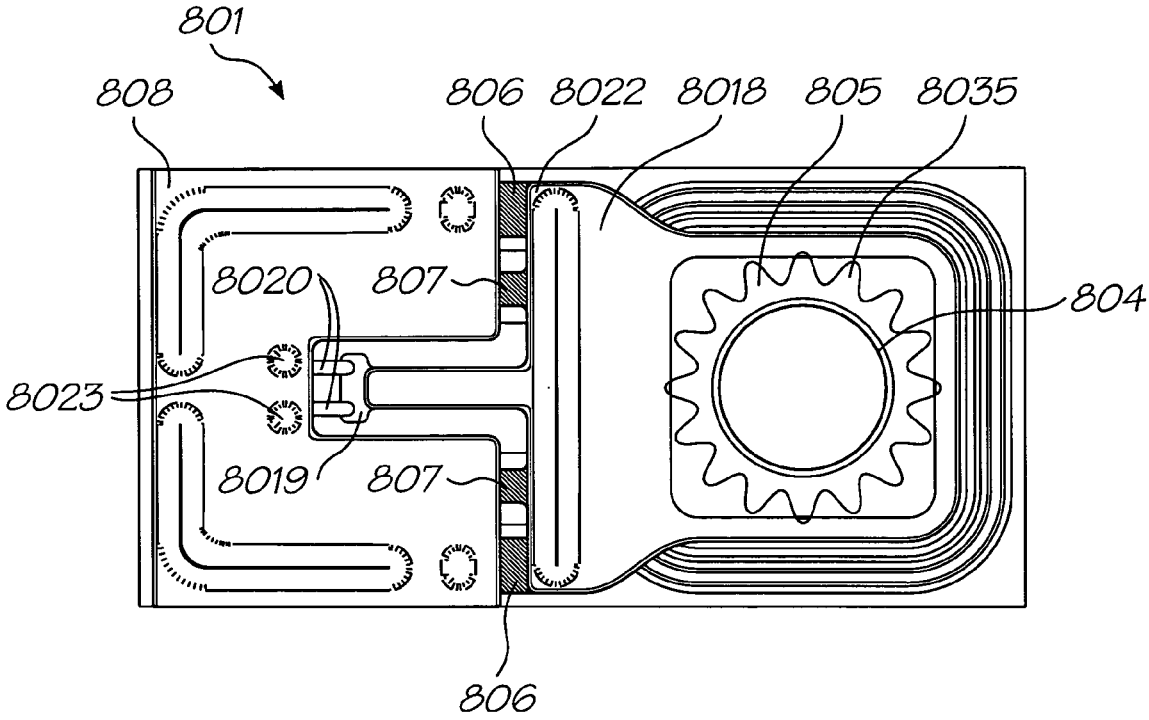
FIG. 25 shows a plan view of the nozzle of FIG. 18.

As best shown in FIG. 25, a plurality of radially extending recesses 8035 is defined in the roof 8034 about the nozzle rim 804. The recesses 8035 serve to contain radial ink flow as a result of ink escaping past the nozzle rim 804.

The nozzle wall 8033 forms part of a lever arrangement that is mounted to a carrier 8036 having a generally U-shaped profile with a base 8037 attached to the layer 8031 of silicon nitride.

Figure 21:
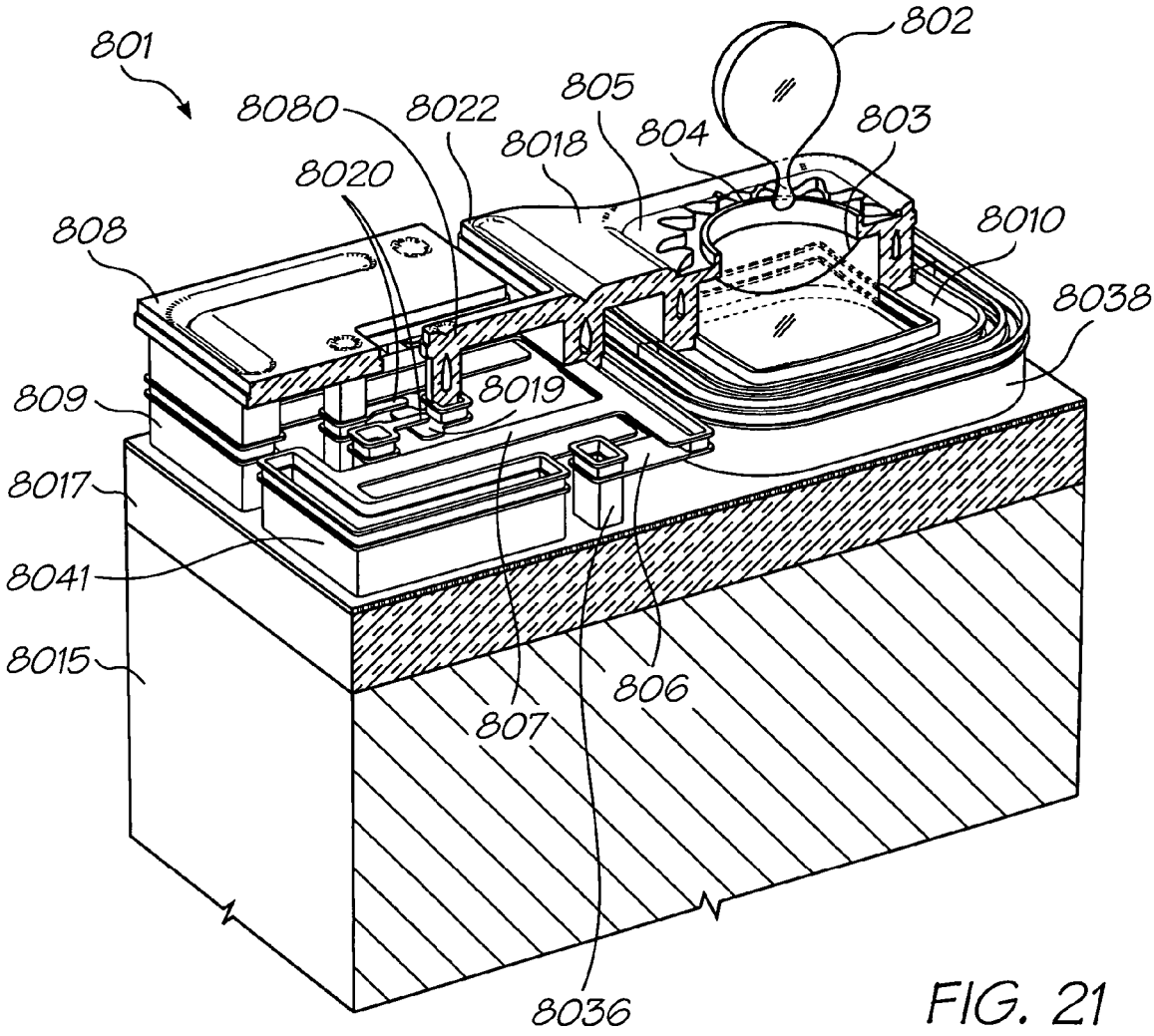
FIG. 21 shows a perspective partial vertical sectional view of the nozzle of FIG. 18, at the actuation state shown in FIG. 20.
Figure 22:
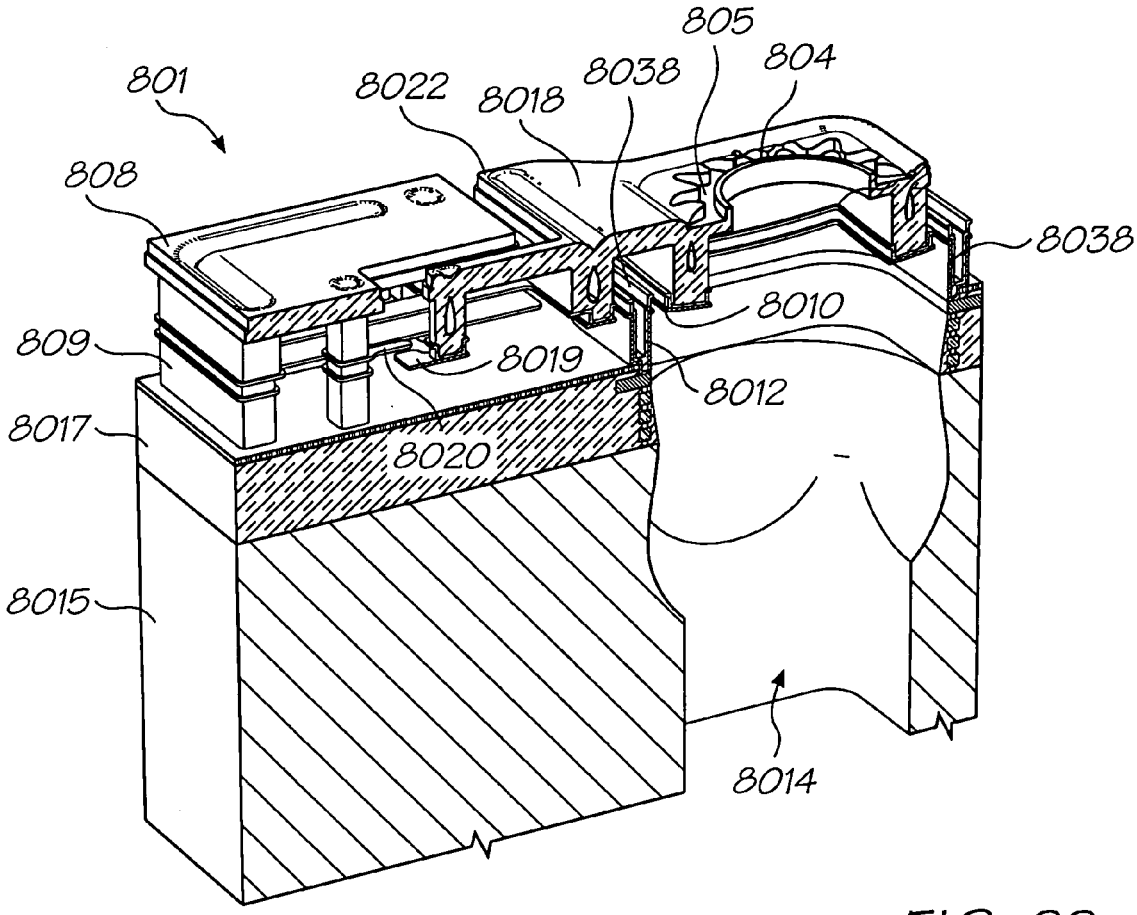
FIG. 22 shows a perspective vertical section of the nozzle of FIG. 18, with ink omitted.
Figure 23:
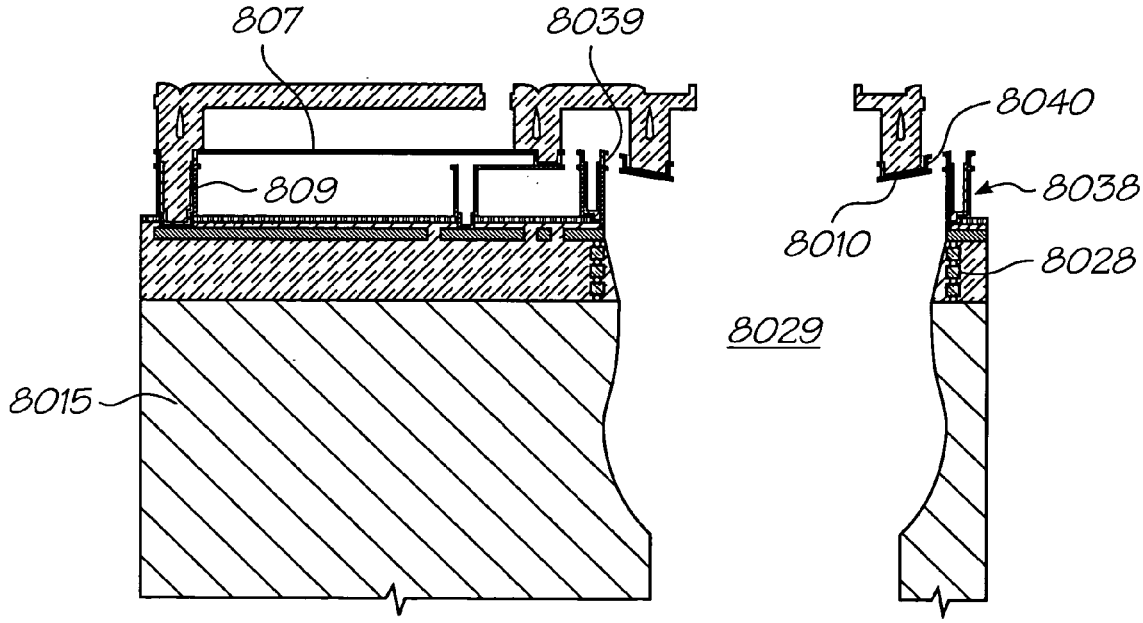
FIG. 23 shows a vertical sectional view of the of the nozzle of FIG. 22.

The lever arrangement also includes a lever arm 8018 that extends from the nozzle walls and incorporates a lateral stiffening beam 8022. The lever arm 8018 is attached to a pair of passive beams 806, formed from titanium nitride (TiN) and positioned on either side of the nozzle arrangement, as best shown in FIGS. 21 and 26. The other ends of the passive beams 806 are attached to the carrier 8036.

The lever arm 8018 is also attached to an actuator beam 807, which is formed from TiN. It will be noted that this attachment to the actuator beam is made at a point a small but critical distance higher than the attachments to the passive beam 806.

Figure 18:
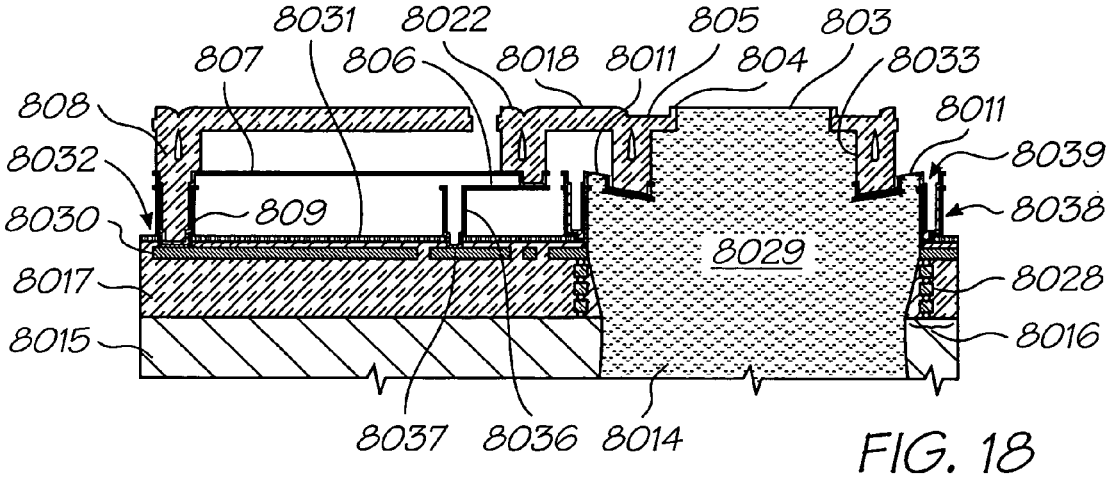
FIG. 18 shows a vertical sectional view of a single nozzle for ejecting ink, for use with the invention, in a quiescent state.
Figure 24:
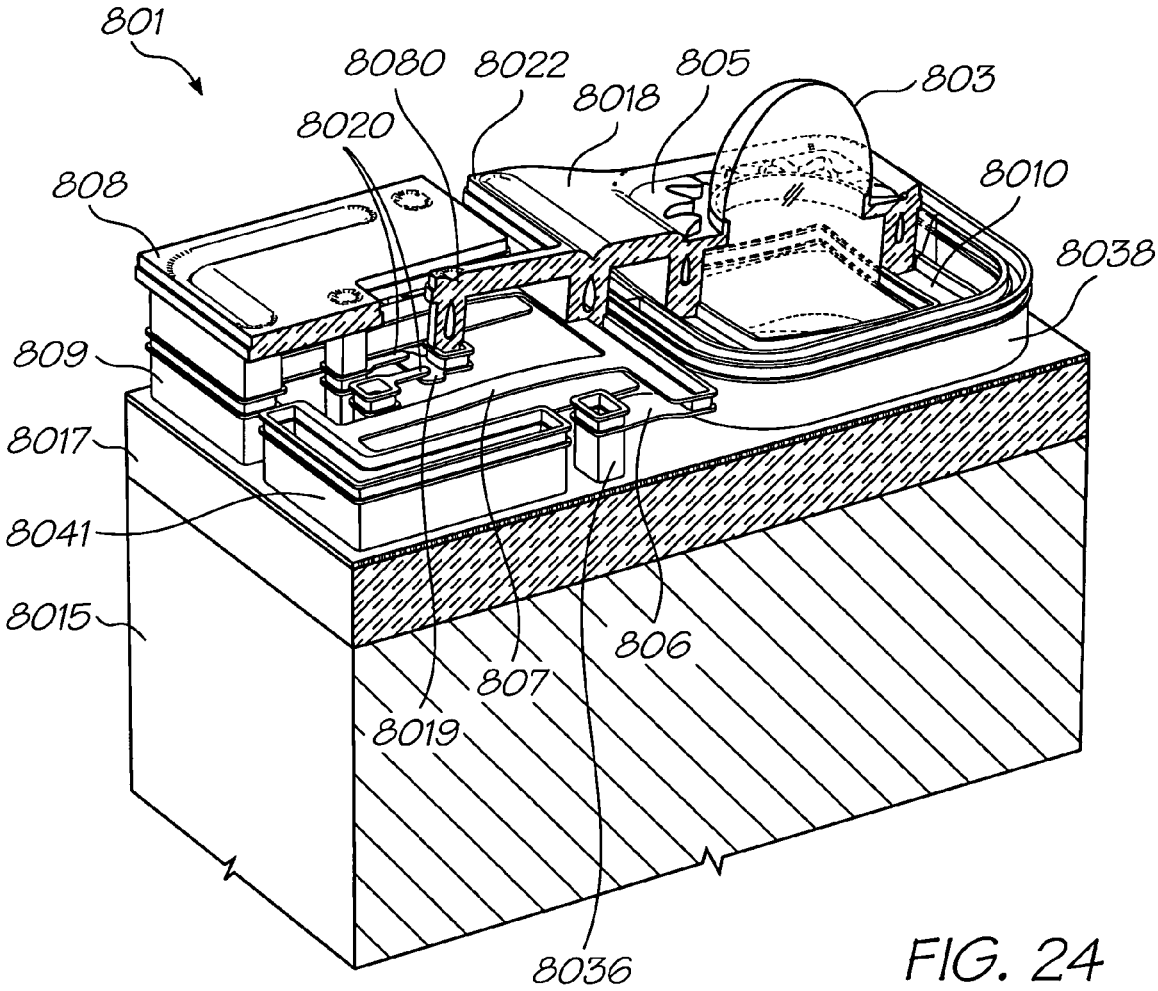
FIG. 24 shows a perspective partial vertical sectional view of the nozzle of FIG. 18, at the actuation state shown in FIG. 19.

As best shown in FIGS. 18 and 24, the actuator beam 807 is substantially U-shaped in plan, defining a current path between the electrode 809 and an opposite electrode 8041. Each of the electrodes 809 and 8041 are electrically connected to respective points in the contact layer 8030. As well as being electrically coupled via the contacts 809, the actuator beam is also mechanically anchored to anchor 808. The anchor 808 is configured to constrain motion of the actuator beam 807 to the left of FIGS. 18 to 20 when the nozzle arrangement is in operation.

The TiN in the actuator beam 807 is conductive, but has a high enough electrical resistance that it undergoes self-heating when a current is passed between the electrodes 809 and 8041. No current flows through the passive beams 806, so they do not expand.

In use, the device at rest is filled with ink 8013 that defines a meniscus 803 under the influence of surface tension. The ink is retained in the chamber 8029 by the meniscus, and will not generally leak out in the absence of some other physical influence.

Figure 19:
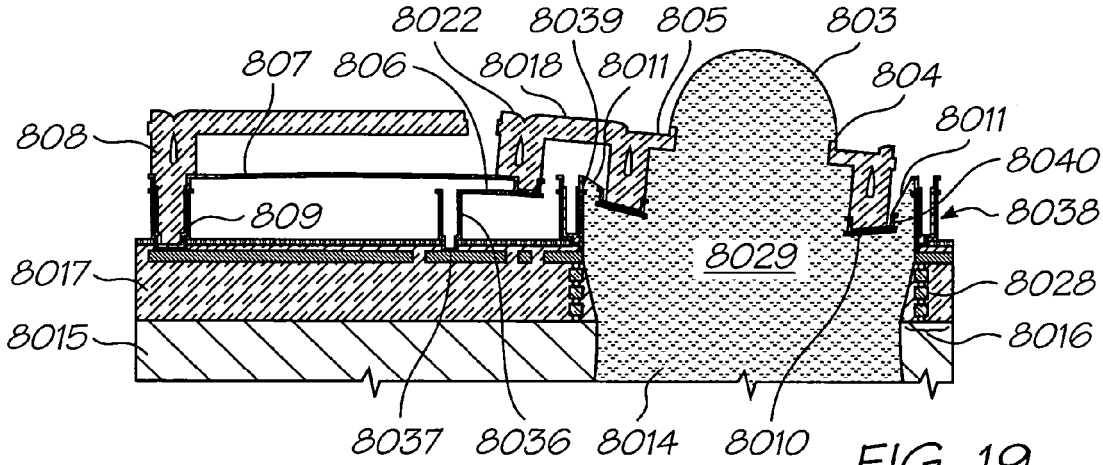
FIG. 19 shows a vertical sectional view of the nozzle of FIG. 18 during an initial actuation phase.

As shown in FIG. 19, to fire ink from the nozzle, a current is passed between the contacts 809 and 8041, passing through the actuator beam 807. The self-heating of the beam 807 due to its resistance causes the beam to expand. The dimensions and design of the actuator beam 807 mean that the majority of the expansion in a horizontal direction with respect to FIGS. 18 to 20. The expansion is constrained to the left by the anchor 808, so the end of the actuator beam 807 adjacent the lever arm 8018 is impelled to the right.

The relative horizontal inflexibility of the passive beams 806 prevents them from allowing much horizontal movement the lever arm 8018. However, the relative displacement of the attachment points of the passive beams and actuator beam respectively to the lever arm causes a twisting movement that causes the lever arm 8018 to move generally downwards. The movement is effectively a pivoting or hinging motion. However, the absence of a true pivot point means that the rotation is about a pivot region defined by bending of the passive beams 806.

The downward movement (and slight rotation) of the lever arm 8018 is amplified by the distance of the nozzle wall 8033 from the passive beams 806. The downward movement of the nozzle walls and roof causes a pressure increase within the chamber 29, causing the meniscus to bulge as shown in FIG. 19. It will be noted that the surface tension of the ink means the fluid seal 11 is stretched by this motion without allowing ink to leak out.

Figure 20:
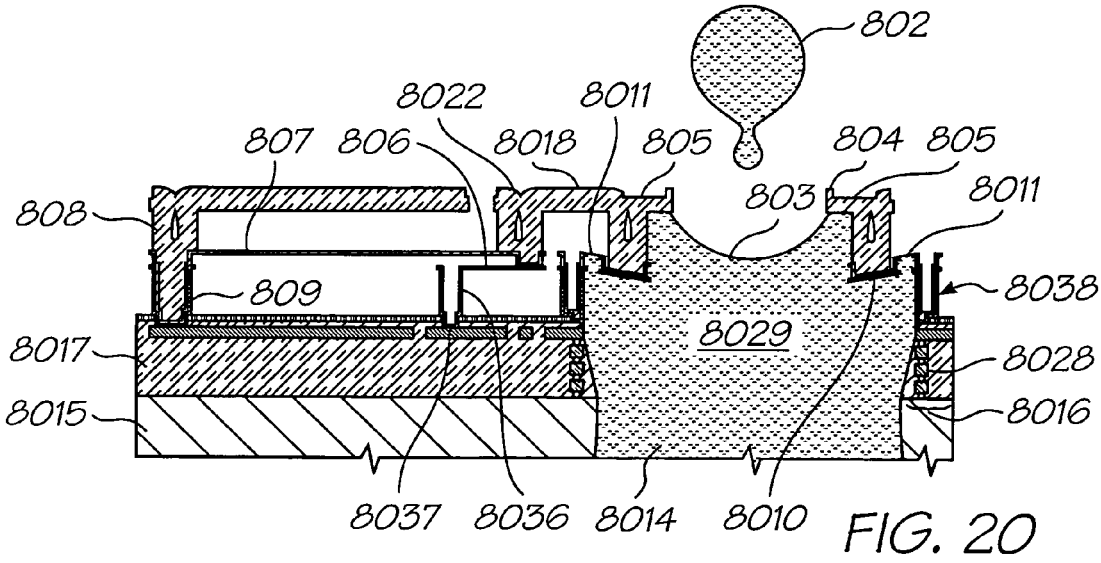
FIG. 20 shows a vertical sectional view of the nozzle of FIG. 19 later in the actuation phase.

As shown in FIG. 20, at the appropriate time, the drive current is stopped and the actuator beam 807 quickly cools and contracts. The contraction causes the lever arm to commence its return to the quiescent position, which in turn causes a reduction in pressure in the chamber 8029. The interplay of the momentum of the bulging ink and its inherent surface tension, and the negative pressure caused by the upward movement of the nozzle chamber 8029 causes thinning, and ultimately snapping, of the bulging meniscus to define an ink drop 802 that continues upwards until it contacts adjacent print media.

Immediately after the drop 802 detaches, meniscus 803 forms the concave shape shown in FIG. 20. Surface tension causes the pressure in the chamber 8029 to remain relatively low until ink has been sucked upwards through the inlet 8014, which returns the nozzle arrangement and the ink to the quiescent situation shown in FIG. 18.

The printhead integrated circuit 81 may be arranged to have between 5000 to 100,000 of the above described nozzles arranged along its surface, depending upon the length of the printhead integrated circuit 81 and the desired printing properties required. For example, for narrow media it may be possible to only require 5000 nozzles arranged along the surface of the printhead to achieve a desired printing result, whereas for wider media a minimum of 10,000, 20,000 or 50,000 nozzles may need to be provided along the length of the printhead to achieve the desired printing result. For full colour photo quality images on A4 or US letter sized media at or around 1600 dpi, the printhead integrated circuit 81 may have 13824 nozzles per color. Therefore, in the case where the printhead integrated circuit 81 is capable of printing in 4 colours (C, M, Y, K), the printhead integrated circuit 81 may have around 53396 nozzles disposed along the surface thereof. Further, in a case where the printhead integrated circuit 81 is capable of printing 6 printing fluids (C, M, Y, K, IR and a fixative) this may result in 82944 nozzles being provided on the surface of the printhead integrated circuit 81. In all such arrangements, the electronics supporting each nozzle is the same.

The manner in which the individual nozzle arrangements 101 are controlled within the printhead integrated circuit 81 will now be described with reference to FIGS. 28-33.

Figure 28:
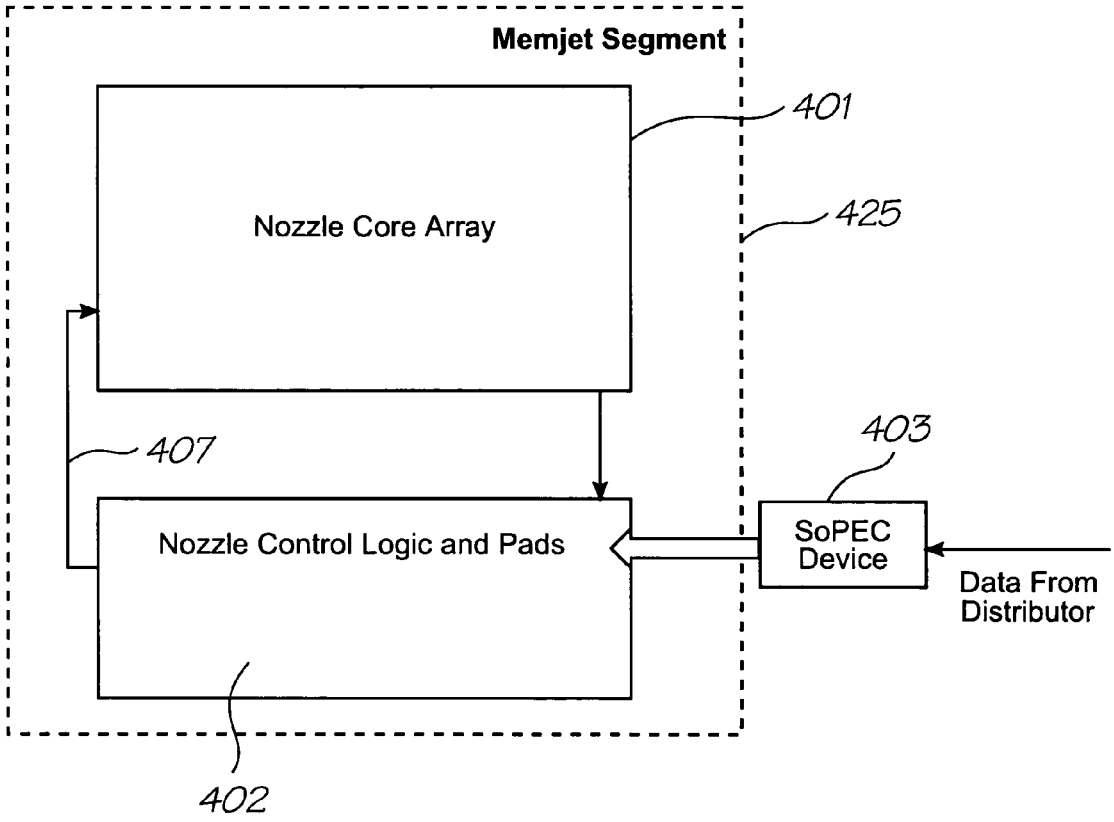
FIG. 28 shows a schematic showing CMOS drive and control blocks for use with the printer of FIG. 4.

FIG. 28 shows an overview of the printhead integrated circuit 81 and its connections to the SoPEC device provided within the control electronics 72 of the printer unit 2. As discussed above, printhead integrated circuit 81 includes a nozzle core array 401 containing the repeated logic to fire each nozzle, and nozzle control logic 402 to generate the timing signals to fire the nozzles. The nozzle control logic 402 receives data from the SoPEC device via a high-speed link.

The nozzle control logic 402 is configured to send serial data to the nozzle array core for printing, via a link 407, which may be in the form of an electrical connector. Status and other operational information about the nozzle array core 401 is communicated back to the nozzle control logic 402 via another link 408, which may be also provided on the electrical connector.

Figure 29:
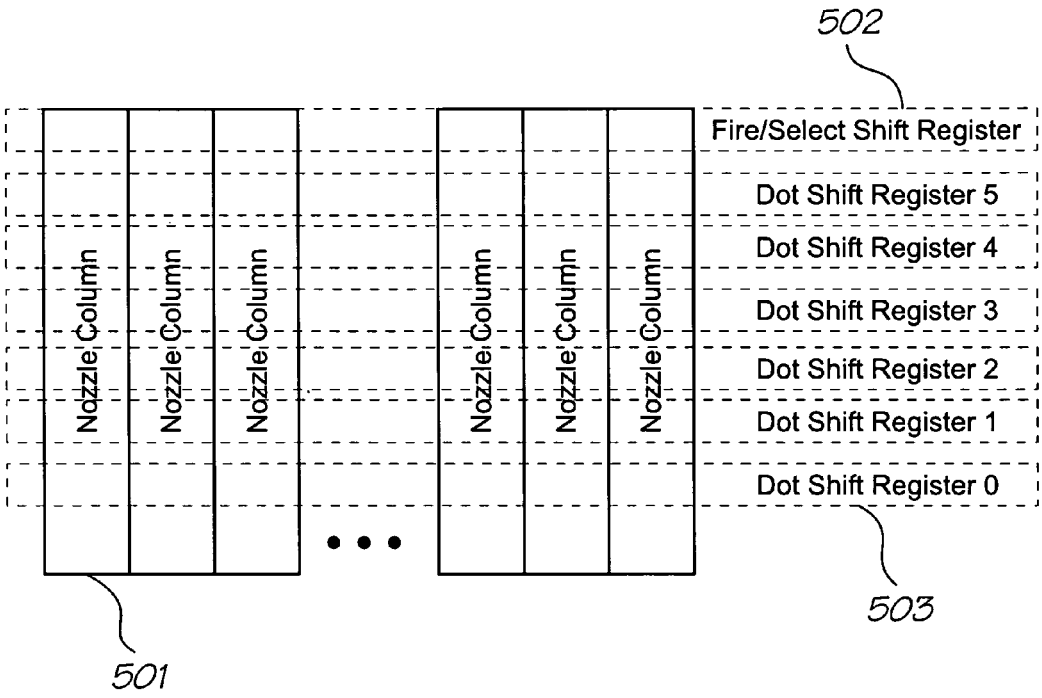
FIG. 29 shows a schematic showing the relationship between nozzle columns and dot shift registers in the CMOS blocks of FIG. 28.
Figure 30:
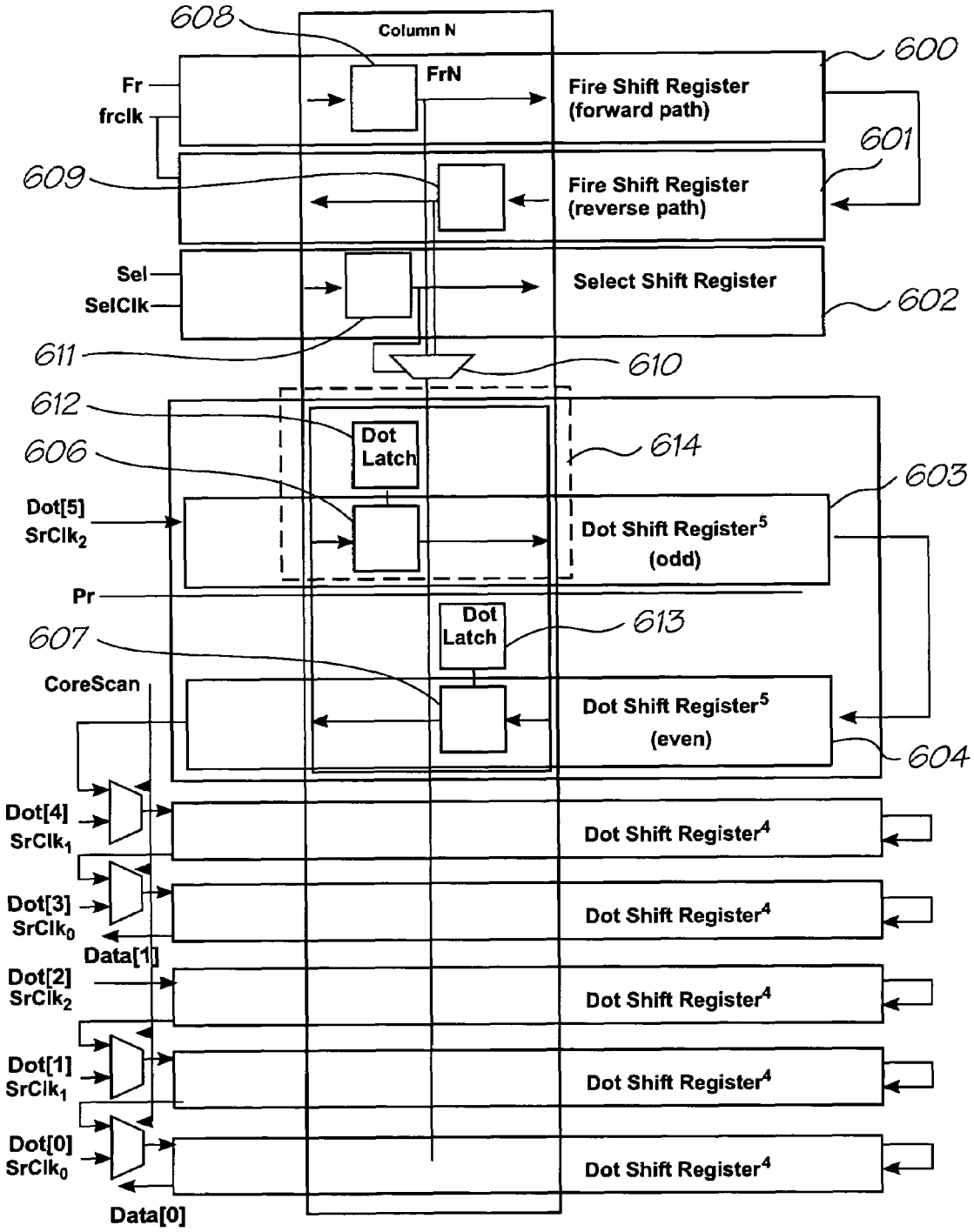
FIG. 30 shows a more detailed schematic showing a unit cell and its relationship to the nozzle columns and dot shift registers of FIG. 29.

The nozzle array core 401 is shown in more detail in FIGS. 29 and 30. In FIG. 29, it will be seen that the nozzle array core 401 comprises an array of nozzle columns 501. The array includes a fire/select shift register 502 and up to 6 color channels, each of which is represented by a corresponding dot shift register 503.

As shown in FIG. 30, the fire/select shift register 502 includes forward path fire shift register 600, a reverse path fire shift register 601 and a select shift register 602. Each dot shift register 503 includes an odd dot shift register 603 and an even dot shift register 604. The odd and even dot shift registers 603 and 604 are connected at one end such that data is clocked through the odd shift register 603 in one direction, then through the even shift register 604 in the reverse direction. The output of all but the final even dot shift register is fed to one input of a multiplexer 605. This input of the multiplexer is selected by a signal (corescan) during post-production testing. In normal operation, the corescan signal selects dot data input Dot[x] supplied to the other input of the multiplexer 605. This causes Dot[x] for each color to be supplied to the respective dot shift registers 503.

A single column N will now be described with reference to FIG. 30. In the embodiment shown, the column N includes 12 data values, comprising an odd data value 606 and an even data value 607 for each of the six dot shift registers. Column N also includes an odd fire value 608 from the forward fire shift register 600 and an even fire value 609 from the reverse fire shift register 601, which are supplied as inputs to a multiplexer 610. The output of the multiplexer 610 is controlled by the select value 611 in the select shift register 602. When the select value is zero, the odd fire value is output, and when the select value is one, the even fire value is output.

Each of the odd and even data values 606 and 607 is provided as an input to corresponding odd and even dot latches 612 and 613 respectively.

Each dot latch and its associated data value form a unit cell, such as unit cell 614. A unit cell is shown in more detail in FIG. 31. The dot latch 612 is a D-type flip-flop that accepts the output of the data value 606, which is held by a D-type flip-flop 614 forming an element of the odd dot shift register 603. The data input to the flip-flop 614 is provided from the output of a previous element in the odd dot shift register (unless the element under consideration is the first element in the shift register, in which case its input is the Dot[x] value). Data is clocked from the output of flip-flop 614 into latch 612 upon receipt of a negative pulse provided on LsyncL.

The output of latch 612 is provided as one of the inputs to a three-input AND gate 65. Other inputs to the AND gate 615 are the Fr signal (from the output of multiplexer 610) and a pulse profile signal Pr. The firing time of a nozzle is controlled by the pulse profile signal Pr, and can be, for example, lengthened to take into account a low voltage condition that arises due to low power supply (in a removable power supply embodiment). This is to ensure that a relatively consistent amount of ink is efficiently ejected from each nozzle as it is fired. In the embodiment described, the profile signal Pr is the same for each dot shift register, which provides a balance between complexity, cost and performance. However, in other embodiments, the Pr signal can be applied globally (ie, is the same for all nozzles), or can be individually tailored to each unit cell or even to each nozzle.

Once the data is loaded into the latch 612, the fire enable Fr and pulse profile Pr signals are applied to the AND gate 615, combining to the trigger the nozzle to eject a dot of ink for each latch 612 that contains a logic 1.

The signals for each nozzle channel are summarized in the following table:

| Name | Direction | Description |
|---|---|---|
| D | Input | Input dot pattern to shift register bit |
| Q | Output | Output dot pattern from shift register bit |
| SrClk | Input | Shift register clock in - d is captured on rising edge of this clock |
| LsyncL | Input | Fire enable - needs to be asserted for nozzle to fire |
| Pr | Input | Profile - needs to be asserted for nozzle to fire |

Figure 31:
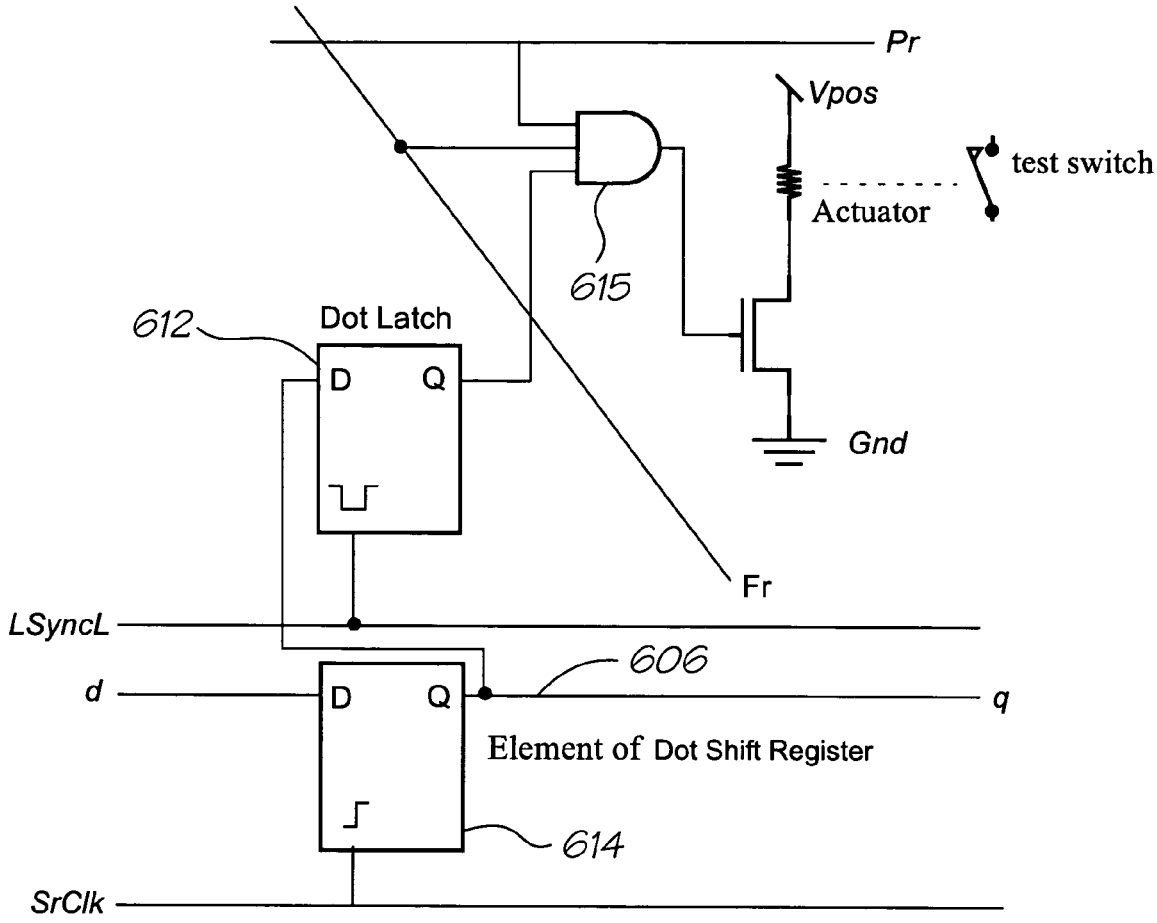
FIG. 31 shows a circuit diagram showing logic for a single printer nozzle in the printer of FIG. 4.

As shown in FIG. 31, the fire signals Fr are routed on a diagonal, to enable firing of one color in the current column, the next color in the following column, and so on. This averages the current demand by spreading it over 6 columns in time-delayed fashion.

The dot latches and the latches forming the various shift registers are fully static in this embodiment, and are CMOS-based. The design and construction of latches is well known to those skilled in the art of integrated circuit engineering and design, and so will not be described in detail in this document.

The nozzle speed may be as much as 20 kHz for the printer unit 2 capable of printing at about 60 ppm, and even more for higher speeds. At this range of nozzle speeds the amount of ink than can be ejected by the entire printhead 81 is at least 50 million drops per second. However, as the number of nozzles is increased to provide for higher-speed and higher-quality printing at least 100 million drops per second, preferably at least 300 million drops per second, and more preferably at least 1 billion drops per second may be delivered. Consequently, in order to accommodate printing at these speeds, the control electronics 72, must be able to determine whether a nozzle is to eject a drop of ink at an equivalent rate. In this regard, in some instances the control electronics must be able to determine whether a nozzle ejects a drop of ink at a rate of at least 50 million determinations per second. This may increase to at least 100 million determinations per second or at least 300 million determinations per second, and in many cases at least 1 billion determinations per second for the higher-speed, higher-quality printing applications.

For the colour printer 100 of the present invention, the above-described ranges of the number of nozzles provided on the printhead chip 81 together with the nozzle firing speeds print speeds results in an area print speed of at least 50 $cm^2$ per second, and depending on the printing speed, at least 100 $cm^2$ per second, preferably at least 200 $cm^2$ per second, and more preferably at least 500 $cm^2$ per second at the higher-speeds. Such an arrangement provides a printer unit 100 that is capable of printing an area of media at speeds not previously attainable with conventional printer units.

As mentioned previously, the above described nozzle arrangements are formed in the printhead integrated circuit 81 of the cartridge unit 80, which forms one part of the print engine 70. The cartridge unit 80 relies upon data and power to be transferred from the control electronics 72 of the cradle unit 71 in order to function and also relies upon the cradle unit 71 to support the printhead integrated circuit 81 in a printing position and deliver the print media past the printhead integrated circuit 81 for printing.

In this regard, the cradle unit 71 forms the second part of the print engine 70 and is retained within the internal cavity 12 of the main body 3 via mountings (not shown) provided on the upper and lower frame units 7, 6. In this position, as shown in FIGS. 13-16, the cradle unit 71 is able to receive data from external data sources via a connector element 73 which is in electrical communication with the data connector sockets 17 provided on the rear 9 of the main body 3. The connector element 73 is preferably a flexible printed circuit board (PCB), positioned to align with a corresponding connector provided on the cradle unit 71. Similarly, power is supplied to the cradle unit 71 from the power supply unit 15 by way of power contacts 74 which extend into the internal cavity 12. The cradle unit 71 is provided with a suitable connector element (not shown) which connects with the power contacts 74 to deliver power to the cradle unit 71.

Figure 13:
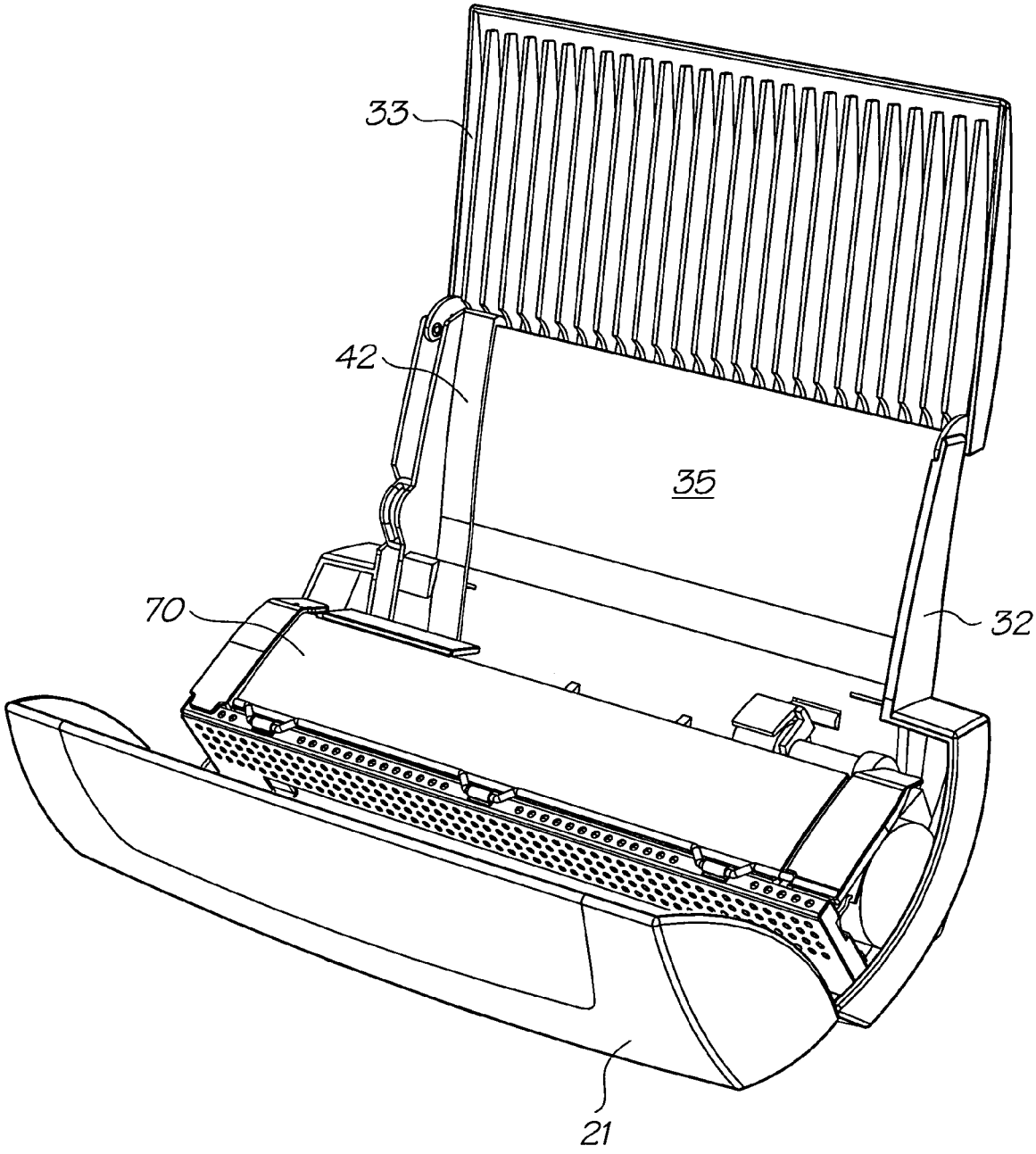
FIG. 13 shows a front perspective view of the printer unit of FIG. 4 with the cover of the printer unit open exposing the print engine.
Figure 14:
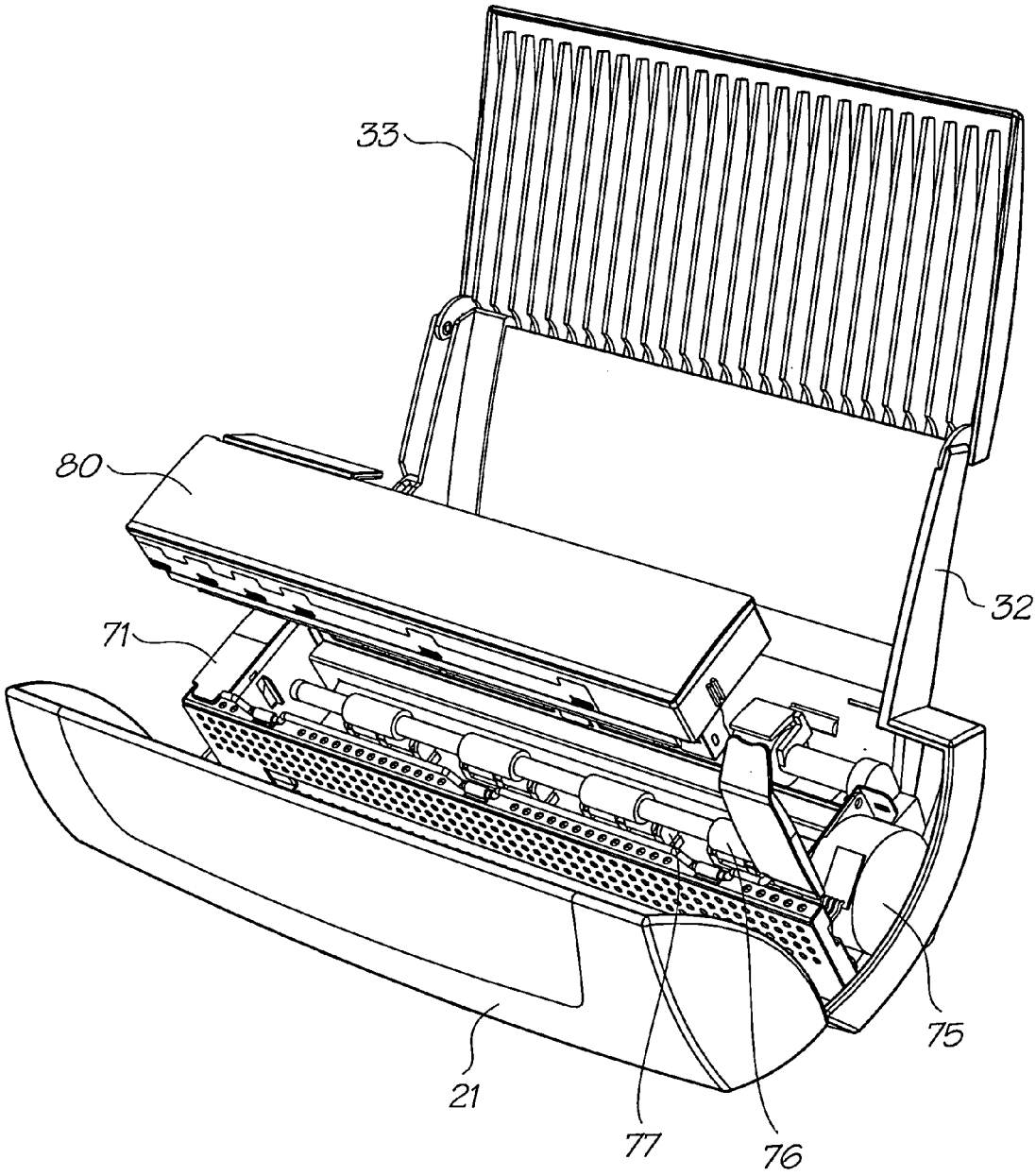
FIG. 14 shows a front perspective view of the printer unit of FIG. 13 with the cartridge removed from the print engine.

As shown more clearly in FIG. 14, the cradle unit 71 is shaped to receive the cartridge unit 80 such that when mated together both units form the print engine assembly 70 as shown in FIG. 13. In this arrangement, data and power is able to be transferred between the units 71, 80 as previously described, thereby allowing the nozzles of the printhead integrated circuit 81 to be controlled in the manner previously descibed.

The body of the cradle unit 71 comprises a drive motor 75, a drive roller 76 and a pinch roller 77 for transporting paper through the print engine 70, a printhead maintenance unit 78 for providing capping and other forms of maintenance to the printhead integrated circuit 81, and control electronics 72 which includes the SoPEC device for controlling the overall operation of the printer unit 2.

The drive motor 75 is a standard brushless DC motor having bidirectional capabilities. The drive motor 75 is gearingly engaged with the drive roller 76 to provide driving motion to the drive roller 76 to control delivery of print media past the printhead integrated circuit 81. The speed at which the drive roller 76 is driven by the motor 75 is controlled by the control electronics 72 to ensure that the paper is delivered past the printhead 81 at the desired rate, which is typically up to, and in excess of, 60 ppm. The drive roller 76 engages with a pinch roller 77 and together the rollers 76, 77 cooperate to capture the print media supplied by the picker mechanism 60 and advance the print media past the printhead integrated circuit 81.

The cradle unit 71 is also provided with a printhead maintenance unit 78 which is also gearingly engaged to the drive motor 75. The printhead maintenance unit 78 includes a capping element that is adapted to be moved into position to cap the printhead integrated circuit 81 of the cartridge unit 80. In such instances, upon determination of an idle state of the printer unit 2, the control electronics 72 initiates engagement of the printhead maintenance unit 78 with the drive motor 75 to move the printhead maintenance unit 78 into capping engagement with the printhead integrated circuit 81. The capping engagement essentially forms a perimeter seal around the ink delivery nozzles of the printhead integrated circuit 81, thereby reducing the evaporation of moisture from the ink present in the ink delivery nozzles, and preventing ink from drying and clogging the nozzles. Similarly, upon determination of the onset of printing, the control electronics 72 initiates uncapping of the printhead integrated circuit 81 thereby allowing the printhead maintenance unit 78 to return to an uncapped position such as that shown in FIG. 16. The printhead maintenance 78 unit may also perform other features such as wiping or blotting of the printhead 81, as necessary.

As shown in FIG. 16, the body of the cradle unit 71 has an inlet 67 provided upstream of the printhead integrated circuit 81, adjacent the picker mechanism 60. The inlet 67 receives a leading edge of the print media delivered by the picker mechanism 60 and includes guide members 69 that assist in directing the leading edge of the print media towards the drive and pinch rollers 76, 77.

An outlet 68 is provided in the body of the cradle unit 71 downstream of the printhead integrated circuit 81 to provide a path for the print media to exit the print engine 70. Following printing by the printhead integrated circuit 81, the leading edge of the printed media exits the print engine 70 via the outlet 68 under the action of the drive and pinch rollers 76, 77. A paper exit mechanism 85 is provided adjacent the outlet 68 to capture the printed sheet for delivery to the media output assembly 5.

The paper exit mechanism 85 is formed on the main body 3 of the printer unit 2 and consists of an exit roller 86 and a plurality of idler wheels 87. The exit roller 86 is provided by an elongate shaft that extends across the front of the lower frame unit 6 and is supported at its ends by a roller support 88 provided on the lower frame unit 6. The exit roller 86 is provided with a number of ring elements 89 equispaced along the length of the shaft which aid in capturing the media for delivery to the media output assembly 5. The exit roller 86 is driven by the drive motor 75 of the cradle unit 71 via drive gears 90 which are positioned at one end of the lower support frame 6. In this arrangement, the control electronics 72 of the cradle unit 71 is able to control the operation of the paper exit mechanism 85 to ensure that it is initiated at an appropriate time and speed to correspond with the speed and timing of the drive roller 76 of the cradle unit 71.

The idler wheels 87 of the paper exit mechanism 85 act in cooperation with the exit roller 86 to capture and deliver the printed media to the media output assembly 5. The idler wheels 87 are flexibly connected to the inside surface of the lid 21 and are arranged to be in rotational contact with the ring elements 89 provided along the shaft of the exit roller 86. As shown in FIG. 13, the idler wheels 87 are in the form of star wheels 91 which rotate upon the surface of the ring elements 89 and capture the media therebetween, such that the printed media can be delivered under action of the exit roller 86 to the media output assembly 5. This arrangement assists in controlling the removal of the sheet of printed media from the print engine 70 following printing.

It should be appreciated that whilst the paper exit mechanism 85 is shown and described as being separate from the print engine 70, it is envisaged that the paper exit mechanism could also be incorporated within the print engine 70. Further, whilst the paper exit mechanism 85 is shown as having star wheels 91, other types of idler rollers could also be employed as would be apparent to a person skilled in the art and still fall within the scope of the present invention.

In the described arrangement, the print engine 70 is located within the internal cavity 12 of the main body 3 between the picker mechanism 60 and the paper exit mechanism 85. This arrangement allows for a simple print media transport path from the media input assembly 4, through the print engine 70, and into the media output assembly 5.

As shown in FIG. 16, in order to simplify the path for the print media as it progresses through the printer unit 2, the print engine 70 is angularly disposed within the internal cavity 12 of the main body 3. The angular disposition of the print engine 70 results in the printhead integrated circuit 81 being angularly disposed, thus providing an angularly disposed printing zone, which aids in providing a shallow path for the print media as it passes from the media input assembly 4 through the printing zone to the media output assembly 5. Such a simplified and shallow print media path allows media of varying thicknesses and types, namely paper up to around 300 gsm, to be printed by the printer unit 2, such a variability in media handling capabilities which is typically lacking in conventional desktop printer units. This arrangement reduces the likelihood of the print media becoming jammed along its path and requiring constant monitoring and rectification and in some instances repair or replacement, should the media contact the printhead integrated circuit 81.

The angle in which the print engine 70 is disposed, and therefore the angle of inclination of the printhead integrated circuit 81, is largely dependant upon the angle with which the print media 10 is supplied to the printer unit 2, in particular the angle of inclination of the media input assembly 4. As shown in FIG. 16, the print media input assembly 4 has an angle of inclination of around 120°, the angle of inclination being measured in a counterclockwise direction from the positive x-axis, with a horizontal surface having an angle of inclination of 0°. The angle of inclination of the print media input assembly could vary from between 90°-160°. In the arrangement shown in FIG. 16, the print engine 70, and subsequently the printhead integrated circuit 81, has an angle of inclination of around 145°, which is greater than the angle of inclination of the print media input assembly 4. Therefore, in order to provide a shallow print media path that is capable of handling print media of varying weights and thicknesses, the printhead integrated circuit 81 is arranged to have an angle of inclination that is greater than the angle of inclination of the print media input assembly.

The above-described characteristics of the printer unit 2 make it possible to provide a desktop printer unit capable of printing high-quality full process colour 1600 dpi images having at least 80% coverage of the page, at speeds in the vicinity of 60 ppm. These characteristics coupled with the reduced footprint and size of the printer unit 2, as discussed earlier, results in a compact high-speed, high-quality printer which has not yet been commercially possible.

For example, the printer unit 2, may be constructed to have an overall width of about 300 mm, an overall height of about 165 mm and an overall depth of about 170 mm. However, other dimensions are possible depending upon the application for the printer.

Thus, it is envisaged that the fully assembled printer unit 2 has a minimum total volume, i.e., the sum of the actual volumes occupied by the components of the printer unit 2 including the main body 3, the media input assembly 4 and the media output assembly 5, of about 8,000 $cm^3$ and a maximum total volume, i.e., the overall space occupied by the printer unit 2, of about 14,000 $cm^3$ (with extended media output assembly and media input assembly). It is envisaged that the present invention could be packaged to occupy a volume between 3000 $cm^3$ to 30,000 $cm^3$. As a result, this results in a printing rate to printer size (volume) ratio of at least about 0.002 ppm/$cm^3$ for printing at 60 ppm. In cases where the printer unit is able to print at even higher rates, i.e., more than 60 ppm and up to as much as 500 ppm for duplex printing as described earlier, a printing rate to a printer size ratio of at least about 0.005 ppm/$cm^3$, preferably at least about 0.01 ppm/$cm^3$ and more preferably at least about 0.02 ppm/$cm^3$ is possible.

Further, the components of the printer 100 including the housing 101, the head unit 102, the source tray assembly 103, the base unit 112 and the various components thereof can in the most part be moulded from lightweight material, such as plastic. As such, along with the above-described reduced size, the weight of the printer 100 can also be reduced. For example, in a preferred form, the printer 100 may have a weight of about 1.5 kg to about 4.6 kg, preferably about 1.8-2.3 kg. Thus, at the above-mentioned possible printing rates of the colour printer 100 beginning at about 30 ppm-60 ppm, a printing rate to printer weight ratio of about 0.5 ppm/kg is possible. Even if different, heavier materials are used for constructing the components of the printer 100 a printing rate to printer weight ratio of at least about 1.0 ppm/kg, preferably at least about 2 ppm/kg, and more preferably at least about 5 ppm/kg is possible as the printing rate is increased. Such printing rates to printer weight ratios are a significant improvement over existing printer units available on the market place which produce full process colour prints having at least 80% image coverage of the page.

It will be appreciated that the printer unit 2 of the present invention provides a desktop printer unit capable of producing full process colour images with at least 80% page coverage at around 60 pages per minute, a feat typically associated with off-line, high volume, dedicated printer units. The printer unit of the present invention has dimensions comparable to, and even lesser than, conventional desktop printers which are not capable of performing at the same speeds and print quality of the present invention.

While the present invention has been illustrated and described with reference to exemplary embodiments thereof, various modifications will be apparent to and might readily be made by those skilled in the art without departing from the scope and spirit of the present invention. Accordingly, it is not intended that the scope of the claims appended hereto be limited to the description as set forth herein, but, rather, that the claims be broadly construed.

What is claimed is:

1. A printer unit comprising:

a body having a media input assembly for supporting media for printing;

a media output assembly for collecting printed media; and a print engine having a printhead for printing an image onto a surface of the media, the printhead being a pagewidth printhead that is user removable from said print engine; wherein, the printer is a desktop printer and the media input assembly is disposed at a first angle of inclination, and the print engine is arranged such that the printhead is at a second angle of inclination, said second angle of inclination being greater than said first angle of inclination.

2. A printer according to claim 1, wherein the printhead is provided on a cartridge and the cartridge is removable from the print engine.

3. A printer according to claim 2, wherein the cartridge is arranged to store one or more printing fluids for printing.

4. A desktop printer according to claim 1, wherein the first angle of inclination is between 90° and 160°.

5. A desktop printer according to claim 4, wherein the first angle of inclination is between 110° and 130°.

6. A printer according to claim 1, wherein the printhead has at least 10,000 ink delivery nozzles arranged thereon.

7. A printer according to claim 6, wherein the printhead has at least 20,000 ink delivery nozzles arranged thereon.

8. A printer according to claim 7, wherein the printhead has at least 50,000 ink delivery nozzles arranged thereon.

9. A printer according to claim 1, wherein the print engine further comprises a control system for operative control of the printhead, and printhead has a plurality of ink ejection nozzles arranged thereon for ejecting individual drops of ink onto a surface of the media such that during use the control system determines whether a nozzle ejects a drop of ink at a rate of at least 50 million determinations per second.

10. A printer according to claim 9, wherein the control system determines whether a nozzle ejects a drop of ink at a rate of at least 100 million determinations per second.

11. A printer according to claim 10, wherein the control system determines whether a nozzle ejects a drop of ink at a rate of at least 300 million determinations per second.

12. A printer according to claim 11, wherein the control system determines whether a nozzle ejects a drop of ink at a rate of at least 1 billion determinations per second.

13. A printer according to claim 1, wherein the print engine further comprises a control system for operative control of the printhead, and the printhead has a plurality of ink ejection nozzles arranged thereon for ejecting individual drops of ink onto a surface of the media, such that during use, the printing speed is controlled to provide a printing speed to printer weight ratio of at least 0.5 ppm/kg.

14. A printer according to claim 13, wherein the printing speed is controlled to provide a printing speed to printer weight ratio of at least 1 ppm/kg.

15. A printer according to claim 14, wherein the printing speed is controlled to provide a printing speed to printer weight ratio of at least 2 ppm/kg.

16. A printer according to claim 15, wherein the printing speed is controlled to provide a printing speed to printer weight ratio of at least 5 ppm/kg.

17. A printer according to claim 1, wherein the print engine further comprises a control system for controlling the printing speed of the printhead, and the printhead has a plurality of ink ejection nozzles arranged thereon for ejecting individual drops of ink onto a surface of the media, such that during use, the printing speed is controlled to provide a printing speed to printer volume ratio of at least 0.002 ppm/cm$^3$.

18. A printer according to claim 17, wherein the printing speed is controlled to provide a printing speed to printer volume ratio of at least 0.005 ppm/cm$^3$.

19. A printer unit according to claim 18, wherein the printing speed is controlled to provide a printing speed to printer volume ratio of at least 0.01 ppm/cm$^3$.

20. A printer unit according to claim 19, wherein the printing speed is controlled to provide a printing speed to printer unit volume ratio of at least 0.02 ppm/cm$^3$.

21. A printer according to claim 1, wherein the print engine further comprises a control system for controlling the printing speed of the printhead, and the printhead has a plurality of ink ejection nozzles arranged thereon for ejecting individual drops of ink onto a surface of the media, such that in use, the printing speed is controlled to provide an area print speed of at least 50 cm$^2$/sec.

22. A printer according to claim 21, wherein the printing speed is controlled to provide an area print speed of at least 100 cm$^2$/sec.

23. A printer according to claim 22, wherein the printing speed is controlled to provide an area print speed of at least 200 cm$^2$/sec.

24. A printer according to claim 23, wherein the printing speed is controlled to provide an area print speed of at least 500 cm$^2$/sec.

25. A printer according to claim 1, wherein the media input assembly is a media tray adapted to receive one or more sheets of media for printing.

26. A printer according to claim 25, wherein the media is paper.

27. A printer according to claim 25, wherein the media tray is inclined in a substantially vertical orientation.

28. A printer according to claim 1, wherein the media output assembly comprises one or more media trays for receiving and collecting media following printing by said printhead.

29. A printer according to claim 28, wherein the one or more media trays are extendable from said body to accommodate variable sized print media.

30. A printer according to claim 1, wherein the print engine comprises a cradle, the cradle being fixedly mounted to said body and adapted to receive the cartridge and support the cartridge in a printing position.

31. A printer according to claim 30, wherein the cradle includes a control system that controls the overall operation of the printer.

32. A printer according to claim 31, wherein the control system includes at least one SoPEC device.

33. A printer according to claim 32, wherein the cradle comprises a media transport system, the media transport system transports media from the media input assembly to the media output assembly, via the printhead.

34. A printer according to claim 33, wherein the cradle has a media inlet for receiving media into the print engine, said media inlet positioned upstream of the printhead proximal to the media input assembly.

35. A printer according to claim 34, wherein the cradle has a media outlet for delivering printed media from the print engine, said media outlet positioned downstream of the printhead, proximal to the media output assembly.

36. A printer according to claim 35, wherein the media transport system comprises a drive roller and a pinch roller which act together to transport the media.

37. A printer according to claim 36, wherein the media transport system comprises a media transport motor for driving the drive roller.

38. A printer according to claim 37, wherein the media transport motor is a brushless DC motor.

39. A printer according to claim 38, wherein the media transport motor is controlled by the control system which controls operation of the media transport system.

40. A printer according to claim 39, wherein the cradle comprises a printhead maintenance element.

41. A printer according to claim 40, wherein the printhead maintenance element has a capping surface which is adapted to cap the printhead.

42. A printer according to claim 41, wherein the printhead maintenance element is movable from a non-capping position to a capping position.

43. A printer according to claim 42, wherein the capping position is a position wherein the capping surface is in contact with the perimeter of the printhead, thereby forming a seal around said printhead.

44. A printer according to claim 43, wherein the movement of the printhead maintenance element is provided by the media transport motor under control of the control system.

45. A printer according to claim 44, wherein the media is supplied to the media inlet from the media input assembly by a media picker system.

46. A printer according to claim 45, wherein the media picker system is mounted to the body and includes a picker roller for delivering the media contained within the media input assembly to the media inlet.

47. A printer according to claim 46, wherein the media picker system has a picker motor that drives said picker roller.

48. A printer according to claim 47, wherein the picker motor is controlled by the control system of the cradle, to control the rate of supply of media to the print engine for printing.

49. A printer according to claim 48, wherein the printed media is delivered to the media output assembly from the media outlet by a media exit mechanism.

50. A printer according to claim 49, wherein the media exit mechanism includes an exit roller and an idler element which captures the printed media and delivers the media to the media output assembly.

51. A printer according to claim 50, wherein the idler element is one or more idler wheels in rotational contact with the exit roller.

52. A printer according to claim 50, wherein the idler element is an idler roller which is in rotational contact with the exit roller.

53. A printer according to claims 51 or 52, wherein the exit roller is driven by media transport motor under control of the control system of the cradle.

54. A printer according to claim 53, wherein the media exit mechanism is mounted to said body adjacent the media outlet of the cradle.

55. A printer according to claim 54, wherein the media exit mechanism is mounted to said cradle adjacent the media outlet.

* * * * *